US008474689B2

(12) United States Patent
Littlejohn et al.

(10) Patent No.: US 8,474,689 B2
(45) Date of Patent: Jul. 2, 2013

(54) METHOD FOR IN-DIE LAMINATION OF PLURAL LAYERS OF MATERIAL AND PAPER-CONTAINING PRODUCT MADE THEREBY

(75) Inventors: Mark B. Littlejohn, Appleton, WI (US); Timothy P. Hartjes, Kimberly, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 696 days.

(21) Appl. No.: 12/638,207

(22) Filed: Dec. 15, 2009

(65) Prior Publication Data

US 2010/0147938 A1 Jun. 17, 2010

Related U.S. Application Data

(60) Provisional application No. 61/201,788, filed on Dec. 15, 2008.

(51) Int. Cl.
*B65D 3/28* (2006.01)

(52) U.S. Cl.
USPC ..... 229/407; 220/62.2; 220/574; 229/406

(58) Field of Classification Search
USPC ..... 229/406, 407; 220/62, 62.13, 62.2, 220/574, 574.3
See application file for complete search history.

(56) References Cited

U.S. PATENT DOCUMENTS

| | | | | |
|---|---|---|---|---|
| 860,385 | A | 7/1907 | Jenkins | |
| 1,912,931 | A | 6/1933 | Clay | |
| 1,974,898 | A * | 9/1934 | Rutledge | 220/574 |
| 2,042,210 | A | 5/1936 | Clay | |
| 2,170,040 | A * | 8/1939 | Stuart | 220/574 |
| 2,231,345 | A | 2/1941 | Potchen | |
| 2,276,035 | A | 3/1942 | Guhl | |
| 2,422,998 | A | 6/1947 | Adams et al. | |
| 2,482,981 | A | 9/1949 | Kamrass | |
| 3,421,967 | A | 1/1969 | Hochner | |
| 3,616,013 | A | 10/1971 | Bocchi | |
| 3,834,606 | A | 9/1974 | Andersson | |
| 4,026,458 | A | 5/1977 | Morris et al. | |
| 4,163,818 | A | 8/1979 | Wernli | |
| 4,588,539 | A | 5/1986 | Rossi et al. | |
| 4,595,611 | A * | 6/1986 | Quick et al. | 220/62.13 |
| 4,606,496 | A | 8/1986 | Marx et al. | |
| 4,609,140 | A | 9/1986 | Van Handel et al. | |
| 4,702,377 | A * | 10/1987 | Grone | 229/407 |
| 4,721,499 | A | 1/1988 | Marx et al. | |

(Continued)

OTHER PUBLICATIONS

Kirk-Othmer, Encyclopedia of Chemical Technology, Third Edition, 1982, pp. 798-799, 815, 831-836, vol. 17, John Wiley & Sons, New York.

(Continued)

*Primary Examiner* — Gary Elkins
(74) *Attorney, Agent, or Firm* — William W. Letson

(57) ABSTRACT

A method for making a multilayered paper-containing product, for example a paper plate or tray, includes assembling two or more sheets of paper-containing material cut into blanks. The blanks are pressed together and shaped in a die, usually with a bonding agent being used to secure the blanks. Pleats are formed in the curved portion of the shaped product. However, the pleats on each blank are formed independently so that the folded region formed in the pleats are arranged in a staggered array and are not interleaved with the pleats of the other blank.

19 Claims, 27 Drawing Sheets

U.S. PATENT DOCUMENTS

| | | | | |
|---|---|---|---|---|
| 4,721,500 | A | 1/1988 | Van Handel et al. | |
| 4,781,566 | A | 11/1988 | Rossi et al. | |
| 4,832,676 | A | 5/1989 | Johns et al. | |
| 4,913,773 | A * | 4/1990 | Knudsen et al. | 162/129 |
| 5,076,874 | A | 12/1991 | Weder | |
| 5,120,382 | A | 6/1992 | Weder | |
| 5,203,491 | A | 4/1993 | Marx et al. | |
| 5,230,939 | A * | 7/1993 | Baum | 229/407 |
| 5,249,946 | A | 10/1993 | Marx | |
| 5,577,989 | A | 11/1996 | Neary | |
| 5,628,451 | A | 5/1997 | Neary | |
| 6,039,682 | A | 3/2000 | Dees et al. | |
| 6,156,398 | A | 12/2000 | Weder et al. | |
| 6,179,203 | B1 | 1/2001 | Toussant et al. | |
| 6,186,394 | B1 * | 2/2001 | Dees et al. | 229/406 |
| 6,270,577 | B1 | 8/2001 | Shanton et al. | |
| 6,287,247 | B1 | 9/2001 | Dees et al. | |
| 6,474,497 | B1 | 11/2002 | Littlejohn et al. | |
| 6,491,214 | B2 * | 12/2002 | Plummer et al. | 229/406 |
| 6,571,980 | B2 | 6/2003 | Lettlejohn et al. | |
| 6,589,043 | B1 | 7/2003 | Johns et al. | |
| 6,592,357 | B1 | 7/2003 | Johns et al. | |
| 6,666,673 | B2 | 12/2003 | Johns et al. | |
| 6,715,630 | B2 | 4/2004 | Littlejohn et al. | |
| 6,733,852 | B2 | 5/2004 | Littlejohn et al. | |
| 6,783,720 | B2 | 8/2004 | Johns et al. | |
| 6,827,890 | B2 | 12/2004 | Johns et al. | |
| 6,893,693 | B2 | 5/2005 | Swoboda et al. | |
| 7,048,176 | B2 | 5/2006 | Littlejohn et al. | |
| 7,070,729 | B2 | 7/2006 | Johns et al. | |
| 7,169,346 | B2 | 1/2007 | Johns et al. | |
| 7,337,943 | B2 | 3/2008 | Johns et al. | |
| 7,540,833 | B2 | 6/2009 | Johns et al. | |
| 2002/0189538 | A1 | 12/2002 | Swoboda et al. | |
| 2005/0184141 | A1 * | 8/2005 | Alexander et al. | 229/407 |
| 2006/0208054 | A1 | 9/2006 | Littlejohn et al. | |
| 2009/0114659 | A1 | 5/2009 | Littlejohn et al. | |

OTHER PUBLICATIONS

U.S. Appl. No. 09/418,851, filed Oct. 15, 1999.

* cited by examiner

FIG. 11A
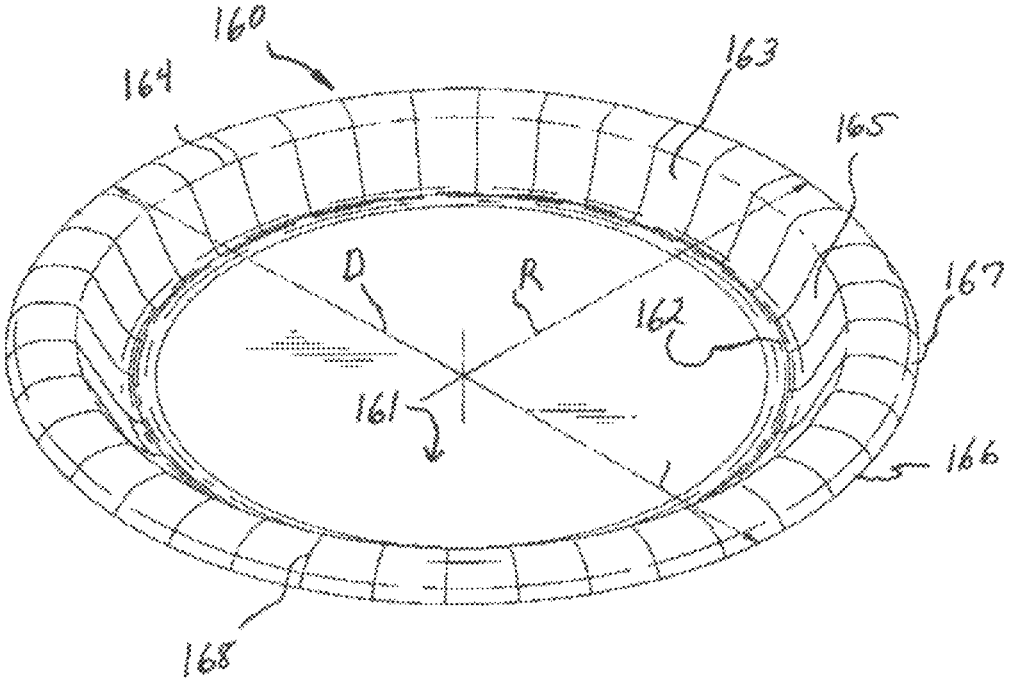
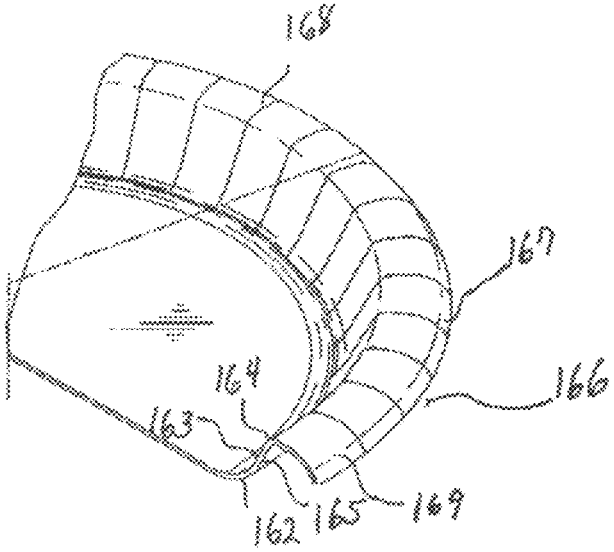
FIG. 11B

METHOD FOR IN-DIE LAMINATION OF PLURAL LAYERS OF MATERIAL AND PAPER-CONTAINING PRODUCT MADE THEREBY

TECHNICAL FIELD

The present disclosure relates to a method for making shaped products from plural layers of material and particularly to a method for making disposable products such as plates, trays, bowls and bakeware by laminating plural layers of paper-containing material and optionally polymeric material in a die.

BACKGROUND OF THE ART

Formed fiber containers, such as paper plates and trays, are commonly produced either by molding fibers from a pulp slurry into the desired form of the container or by pressing a paperboard blank between forming dies into the desired shape.

Pressed paperboard containers may be made as noted in one or more of U.S. Pat. Nos. 4,606,496; 4,609,140; 4,721,499; 4,721,500; 5,203,491; 6,715,630; and United States Patent Application Publication No. 2006/0208054 (pending as U.S. patent application Ser. No. 10/963,686). Equipment and methods for making paperboard containers are also disclosed in U.S. Pat. Nos. 4,781,566; 4,832,676; 5,249,946 and 4,588,539. U.S. Pat. Nos. 6,186,394 and 6,039,682 disclose composite paperboard containers having embossed surfaces.

Pulp molded articles, after drying, are strong and rigid but generally have rough surface characteristics and generally contain far more fiber than pressed paperboard plates. They are not usually coated and are susceptible to penetration by water, oil and other liquids. Pressed paperboard containers, on the other hand, can be decorated and coated with a liquid-resistant coating before being stamped by the forming dies into the desired shape. Pressed paperboard containers generally contain far less fiber and cost less, requiring less storage space than the molded pulp articles. Large numbers of paper plates and similar products are produced by each of these methods every year at relatively low unit cost. These products come in many different shapes, rectangular or polygonal as well as round, and in multi-compartment configurations.

Primarily, due to the presence of pleats, even well pressed paperboard containers have tended to exhibit somewhat less strength and rigidity than do comparable containers made by the pulp molding processes. Much of the strength and resistance to bending of a plate-like container made by either process lies in the sidewall and rim areas surrounding the center or bottom portion of the container. When in use, such containers are often supported by the rim and sidewall while the weight held by the container is located on the bottom portion. Thus, the rim and sidewall generally are placed in tension and flexure when the container is being used.

In plate-like structures made by the pulp molding process, the sidewall and overturned rim of the plate are unitary, cohesive fibrous structures which have considerable resistance to bending as long as they are not damaged or split. Because the rim and sidewall of the pulp molded containers are of a cohesive, unitary structure, they may be placed under considerable tension and flexure without failing. Plates produced by the pulp molding process do not typically have a continuous functional coating to prevent strength loss during use with hot, moist foods. Internal chemicals can be used to retard moisture and grease absorption. For improved moisture resistance, a secondary film can be laminated to the plate in a separate, post formation, step resulting in a significantly higher cost.

In contrast, when a container is made by pressing a paperboard blank, the flat blank must be distorted and changed in shape and area in order to form the blank into the desired three dimensional shape. This necessary distortion results in seams or pleats in the sidewall and rim, the areas of the container which are drawn in toward the center in press forming the container resulting in a decrease in the circumference of the formed container as compared to the blank. Unless considerable care is employed during the process of pressing, these seams or pleats can constitute material lines of weakness in the sidewall and rim areas about which such containers tend to bend more readily than do containers having unpleated sidewalls and rims. Moreover, such seams or pleats will often have a tendency to open or unfold under tension or flexure as if attempting to return to their original flat shape, particularly if exposed to moisture, or even worse, moisture at elevated temperatures. The necessary location of these pleats in the sidewall and rim of pressed paperboard containers places the greatest weakness in the area requiring the greatest strength. Unless carefully formed, such containers have typically have been unable to support loads comparable to pulp molded containers of equivalent fiber content. Under tension, flexure or torsion, pleats exhibit a tendency to open and/or hinge. Accordingly, most known pressed paperboard containers typically have significantly less load carrying ability than do pulp molded containers unless particular care is employed to transform disrupted regions in the plates into substantially integrated fibrous structures during the pressing process. In contrast to pulp molded plates, the pressed containers can easily have a continuous functional coating applied to the paperboard prior to forming, resulting in enhanced performance with hot and moist foods. Being less costly than an equivalent pulp molded plate, a pressed paperboard plate with enhanced strength and Rigidity as well as a better moisture barrier would have significant commercial value.

Further, pressed paperboard plates typically have relatively poor insulation properties as a result of their thinner material construction. Consequently, the bottom of the plate can get warm when hot food is placed on top. Carrying hot food can be uncomfortable for the user of the plate.

Many efforts have been made to strengthen pressed paperboard containers while accommodating the necessary reduction in area at the sidewalls and rims. Blanks from which paperboard containers are pressed have been provided with score lines at their periphery to eliminate the random creation of seams or pleats. The score lines are typically provided in a manner that results in internal delamination of the scored areas of the blank, thereby causing the pleats to form in the scored areas but generally, at least according to conventional wisdom, leading to plates with slightly lower strength than equivalent plates with random pleats. Scores can be created either on the top side or the bottom side of a blank. The score lines thus define the locations of the seams or pleats. As alluded to before, efforts have been made in pressing the pleats to reform the disrupted regions caused by internal delamination attendant upon formation of a plate in order to improve Rigidity. While substantial reforming is possible, it is commonly less than ideal in most real world manufacturing processes as obtaining the best results requires considerable care in selecting the appropriate contours for the dies, maintaining the dies in alignment, ensuring that the board is moisturized to the appropriate levels and temperatures are maintained within the desired ranges as well as assuming that sufficient pressure is applied to reform the bonds in the descriptive regions. Unfortunately, it has not proved trivial to greatly increase the strength of pressed paperboard plates beyond that attainable with 230 pound board, by merely increasing the basis weight of the paperboard blank from which they are formed as the difficulty of forming well integrated pleats seems to increase with the caliper of the blank.

Various methods of making pressed paper articles are known in the art. For example, U.S. Pat. No. 860,385 discloses a method of making paper tube caps from multiple layers of paper. The meeting faces of the paper layers have glue applied thereto, and the compound multilayered paper blank is formed in a die before the glue sets.

U.S. Pat. No. 2,231,345 discloses a method of making multi-ply trays from paper stock and wood. The layers are pressed together in such a way as to form corrugations in the paper in the corners of the tray so as to offset the tendency of the paper to wrinkle.

Pressed paperboard products can be fabricated from a single thick layer of paperboard. However, one reason the pressed paper plates are often weaker than pulp molded plates lies in the basis weight range which can most easily be formed into plates. Thick layers of board are more difficult to pleat and form properly than one or multiple thinner layers. Thus, one way that has been attempted to fabricate stronger paper products is assembling two or more layers of paper and/or other sheet material.

Prior art methods often employ interleaving for securing multiple layers of paper or other material. Referring to FIGS. 1 and 2, for example, a layered structure 1 containing an upper paper layer 2 and a bottom paper layer 3 is shown. The upper paperboard layer 2 has an upper surface 2*a* and a lower surface 2*b*. The lower paperboard layer 3 has an upper surface 3*a* and a lower surface 3*b*. Typically, one or both layers is not shape-sustaining. A non shape-sustaining sheet of material will sag or droop under its own weight, for example, if a plate sized blank is held only at one edge even if a slight downward bow is applied transversely to the bending moment in the web as will be appreciated by one of skill in the art.

Optionally, a layer of adhesive 4 between the lower surface 2*b* of the upper layer and upper surface 3*a* of the lower layer secures the paperboard layers 2 and 3 in a fixed relative position prior to forming.

When formed into a pleated configuration as shown in FIG. 2, pleat 5 is formed into an interleaved configuration because the upper paperboard layer 2 and the lower paperboard layer 3 do not pleat independently of each other. As can be seen, lower paperboard layer 3 has one or more sinuous (S- or Z-shaped) pleated portions or folds 3*c* and/or 3*d*, and upper paperboard layer 2 has one or more sinuous folds 2*c* and/or 2*d*. However, it can be seen that these folds are vertically disposed one above the other in the layers. Thus, the sinuous folds in pleated portions 3*c* and 3*d* of the lower paperboard layer 3 are directly above the respective sinuous folds in the pleated portions 2*c* and 2*d* of the upper paperboard layer 2. For ease of reference, we term this form of pleating "interleaved pleating." Interleaved pleating (with or without adhesive) is shown, for example, in U.S. Pat. Nos. 5,203,491 and 5,120,382. Typically, a pleat will consist of one or two sinuous regions with pleats comprising a Z-shaped region next to an S-shaped region being preferred and referred to as U-shaped pleats or omega-shaped pleats depending upon the relative positions of the S-shaped and Z-shaped regions. In our experience, when two layers of board are used in plate making, interleaved pleats provide little benefit over use of a single layer of comparable thickness.

There yet remains a problem in that a single thick layer of paperboard is more difficult to form and pleat properly than one or more multiple thin layers. However, interleaved pleats of multilayered paper products can result in pronounced lines of weakness which can open or hinge during use carrying food, or other loads, or from handling or flexing.

What is needed is a method for making multi-ply products, particularly paper products, which avoids these difficulties.

SUMMARY OF THE INVENTION

A method for making a multilayered paper-containing product is provided herein. The method comprises the steps of: (a) providing at least a top blank of paper material and a bottom blank of paper material; (b) assembling said top and bottom blanks in a superposed arrangement; (c) forming interspersed pleats in the top and bottom blanks such that the folded regions forming the pleats in the top blank do not interleave with the pleats in the bottom blank but rather are disposed in a staggered arrangement relative to the folds forming the pleats in the bottom layer; while (d) securing the top and bottom blanks in a fixed position relative to each other so as to form an integral paper-containing product.

The paper product thus formed advantageously does not have pleats wherein the folds forming the pleats in the top layer are interleaved with the folds forming the pleats in the bottom layer but rather are staggered between the layers. This feature avoids the formation of weak spots in the product.

BRIEF DESCRIPTION OF THE DRAWINGS

Various embodiments are described herein with reference to the drawings wherein:

FIG. 11A is a perspective view of a formed paper-containing plate;

FIG. 11B is a cut-away view of the plate shown in FIG. 11A;

DETAILED DESCRIPTION OF PREFERRED EMBODIMENT(S)

Figure 1:
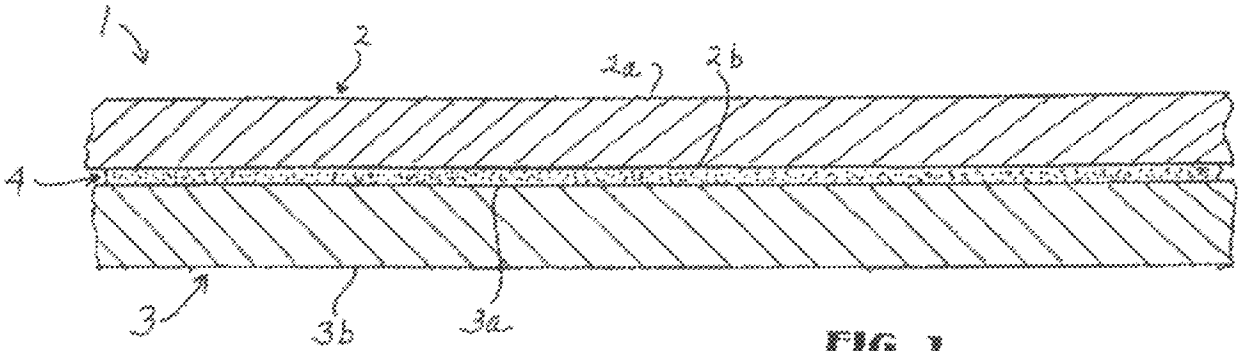
FIG. 1 (Prior Art)
FIG. 1 is a partial sectional view of a prior art stacked arrangement of paper blanks prior to forming.

The present invention is directed to in-die lamination of two or more layers of paperboard or other fibrous cellulosic material to form rigid, disposable, multi-ply (also termed "multilayered") products such as pressware plates, bowls or trays. Typically, such products have curved surfaces which result in gathering of excess sheet material into folds or pleats when a flat blank is pressed in a die to form the desired shape.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below and hereinafter in this description.

"Activatable adhesive" and like terminology refers to an adhesive between layers which is not operative to lock adjacent layers to each other prior to being activated by application of heat or steam, for example, to bond the layers together. That is, an activatable adhesive allows movement of adjacent paperboard layers during the container forming process so that pleats in different layers can form independently of each other and locks the layers in position when fabrication is complete such as when the product cools. While in a non-adhesive state, the activatable adhesive will not adhere adjacent layers paperboard together to the extent independent pleating in the various layers is prevented. Typically, the activatable adhesive will allow separation of layers without substantial fiber tear prior to activation. The activatable adhesive may be a water soluble glue, for example, or a thermoplastic composition, or be both water soluble and thermoplastic. Water-soluble glues include an adhesive agent disposed in water as a carrier, and which will re-disperse in water after it is dried to a film. Water-soluble glues include, for example, polyvinyl acetate homopolymer or copolymer based emulsions, acrylic emulsions, casein formulations, dextrine/starch-based adhesives, and natural rubber latex. Of these, a polyvinyl acetate homopolymer or copolymer emulsion-based adhesive is sometimes preferred. Water insoluble adhesives, on the other hand, include acrylate and olefin based hot-melt adhesives and so forth as well as glues which include an organic carrier. The activatable adhesive is typically activated by heat, steam or both in order to bond the layers together in accordance with the invention.

"Rigidity" and like terminology refers to SSI Rigidity as hereinafter defined.

A non shape-sustaining product or sheet of material will sag or droop under its own weight, for example, if a plate sized blank is held only at one edge even if a slight downward bow is applied transversely to the bending movement in the web. A shape-sustaining material will substantially hold its shape under the same circumstances. Thus, tissue paper is usually non shape-sustaining whereas paperboard usually is shape-sustaining in the grades and weights typically encountered in paper plates used for carrying food. Typically, a paperboard layer is shape-sustaining if it has a Taber stiffness (T 489 om-99) of more than 15 gm-cm in the CD and have more than 25 g-cm in the MD. A non shape-sustaining material has Taber stiffness values of less than 10 gm-cm in both the MD and CD. Taber values are measured on any suitable apparatus, preferably an automated apparatus in an instrument range suitable for the stiffness unit values of the specimen.

A shape-sustaining paperboard layer or layers will typically droop less than 45° with respect to a horizontal when held at one edge of a plate-sized blank, whereas a non-shape sustaining layer will droop more than 45°. A "shape-sustaining layer" of a product and like terminology refers to the characteristics of a paperboard layer used to make the product, while a "shape-sustaining product" and like terminology refers to the fact that the formed product is shape-sustaining as determined by Taber testing of a composite specimen (T 489 om-99) taken from the central portion of a formed container or by way of preparing a composite paperboard blank from the same material as the product, laminating the layers in substantially the same manner as the product is formed and determining the stiffness characteristics of the composite.

Figure 2:
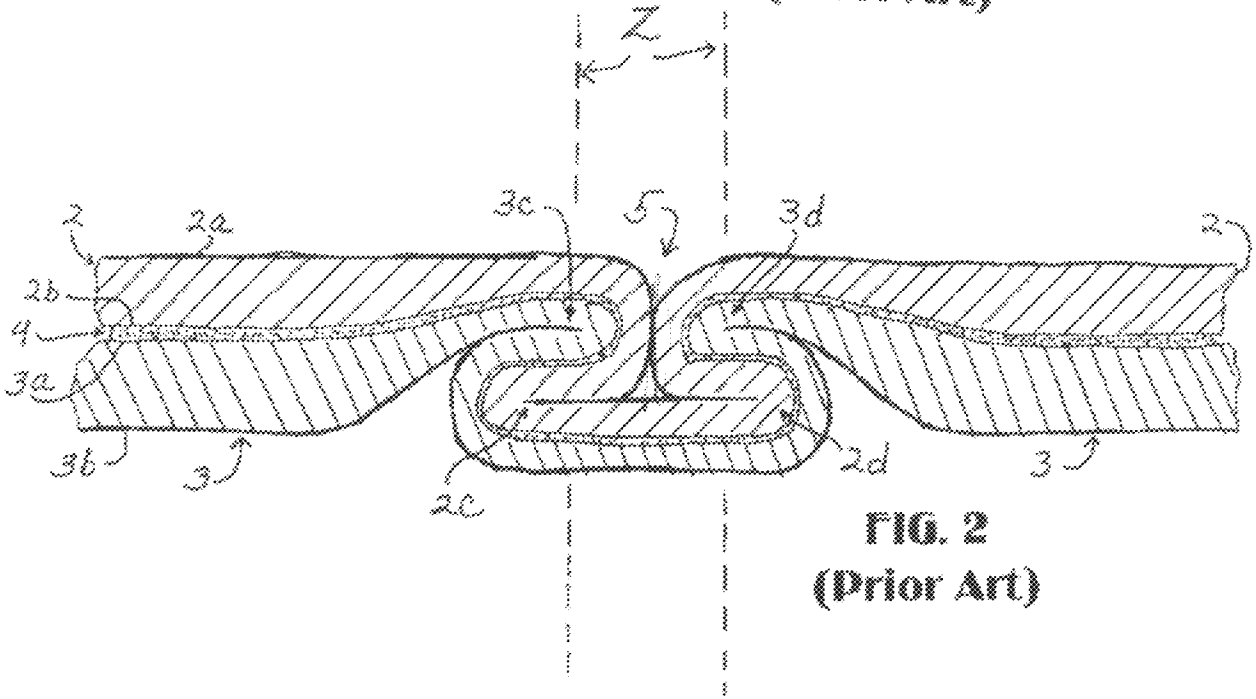
FIG. 2 (Prior Art)
FIG. 2 is a sectional view of a portion of a prior art paper product showing an interleaved pleat structure.
Figure 3:
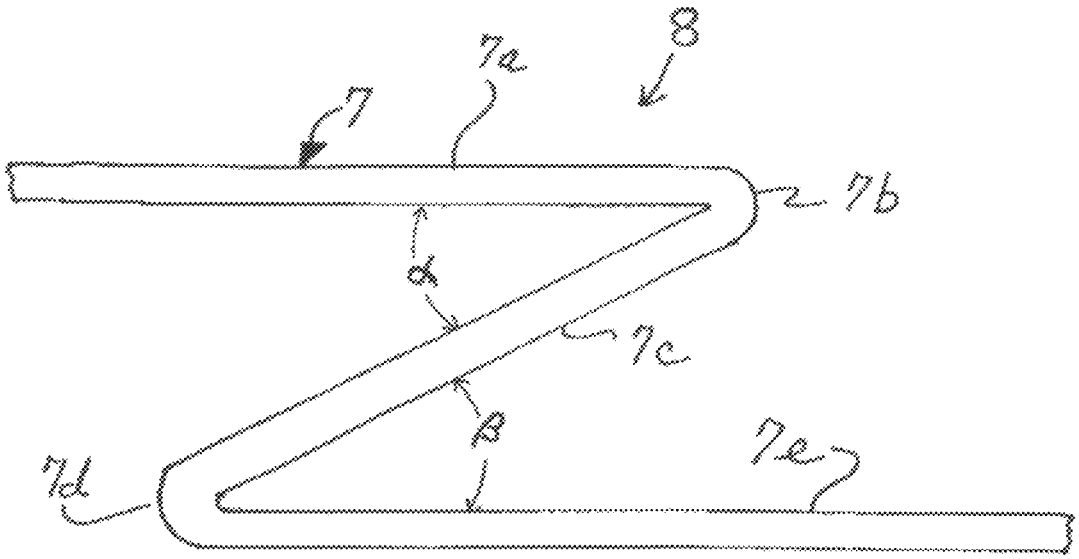
FIG. 3 is a diagram of a single pleat.

Referring to FIG. 3, a Z-shaped pleat 8 in a layer 7 of material is shown wherein 7*a* is a first portion of layer 7 which extends laterally, bends at fold 7*b*, extends at portion 7*c* to a second fold 7*d* wherein it bends and then extends laterally again at portion 7*e*. Fold 7*b* is characterized by angle $\alpha$ and fold 7*d* is characterized by angle $\beta$. Typically, $\alpha$ is approximately equal to $\beta$, and both $\alpha$ and $\beta$ are less than 90°. FIG. 3 shows a simple pleat 8 consisting of one Z-shaped configuration which is not pressed flat. Referring again to FIG. 2, a compound pleat 5 which is pressed flat is shown in a Z-ply structure consisting of two back-to-back sinuous folds in particular a Z-shaped fold and an S-shaped fold.

The following patents and co-pending applications contain further information as to materials, processing techniques and equipment and are herein incorporated by reference: U.S. patent application Ser. No. 09/603,579, filed Jun. 26, 2000, entitled "Smooth Profiled Food Service Articles", now U.S. Pat. No. 6,474,497; U.S. patent application Ser. No. 10/236,069, filed Sep. 5, 2002, entitled "Smooth Profiled Food Service Articles", now U.S. Pat. No. 6,571,980; U.S. patent application Ser. No. 09/678,930, filed Oct. 4, 2000, entitled "Punch Stripper Ring Knock-Out for Pressware Die Sets", now U.S. Pat. No. 6,589,043; U.S. patent application Ser. No. 09/653,577, filed Aug. 31, 2000, entitled "Rotating Inertial Pin Blank Stops for Pressware Die Sets", now U.S. Pat. No. 6,592,357; U.S. patent application Ser. No. 10/428,673, filed May 2, 2003, entitled "Side Mounted Temperature Probe for Pressware Die Sets", now U.S. Pat. No. 6,666,673; U.S. patent application Ser. No. 10/348,278 filed Jan. 17, 2003, entitled "Disposable Food Container With Linear Sidewall Profile and an Arcuate Outer Flange", now U.S. Pat. No. 6,715,630; U.S. patent application Ser. No. 09/921,264, entitled "Disposable Serving Plate With Sidewall-Engaged Sealing Cover", now U.S. Pat. No. 6,733,852; U.S. patent application Ser. No. 10/437,364, filed May 13, 2003, entitled "Punch Stripper Ring Knock-Out for Pressware Die Sets", now U.S. Pat. No. 6,783,720; U.S. patent application Ser. No. 10/424,804, filed Apr. 28, 2003, entitled "Side Mounted Temperature Probe for Pressware Die Sets", now U.S. Pat. No. 6,827,890; U.S. patent application Ser. No. 10/004,874, filed Dec. 7, 2001, entitled "High Gloss Disposable Pressware", now U.S. Pat. No. 6,893,693; U.S. patent application Ser. No. 09/978,484, filed Oct. 17, 2001, entitled "Deep Dish Disposable Pressed Paperboard Container", now U.S. Pat. No. 7,048,176; U.S. patent application Ser. No. 10/236,721, filed Sep. 6, 2002, entitled "Improved Pressware Die Set with Product Ejectors at Outer Forming Surfaces", now U.S. Pat. No. 7,070,729; U.S. patent application Ser. No. 10/424,777, filed Apr. 28, 2003, entitled "Rotating Inertial Pin Blank Stops for Pressware Die Sets", now U.S. Pat. No. 7,169,346; U.S. patent application Ser. No. 10/600,814, filed Jun. 20, 2003, entitled "Disposable Servingware Containers with Flange Tabs," now U.S. Pat. No. 7,337,943; U.S. patent application Ser. No. 09/418,851, filed Oct. 15, 1999, entitled "A Paperboard Container Having Enhanced Grease Resistance and Rigidity and a Method of Making Same; U.S. patent application Ser. No. 10/156,342, filed May 28, 2002, entitled "Coated Paperboard, Method and Apparatus for Producing Same," United States Patent Application Publication No. US 2002/0189538; U.S. patent application Ser. No. 10/963,686, filed Oct. 13, 2004, entitled "Pressed Paperboard Servingware with Improved Rigidity and Rim Stiffness", United States Patent Application Publication No. US 2006/0208054; U.S. patent application Ser. No. 12/259,487, filed Oct. 28, 2008, entitled "Pressed Paperboard Servingware with Arched Bottom Panel and Sharp Brim Transition, United States Patent Application Publication No. US 2009/0114659; and U.S. patent application Ser. No. 12/017,393, filed Jan. 22, 2008, entitled "Disposable Servingware Containers with Flange Tabs", now U.S. Pat. No. 7,540,833.

Figure 4:
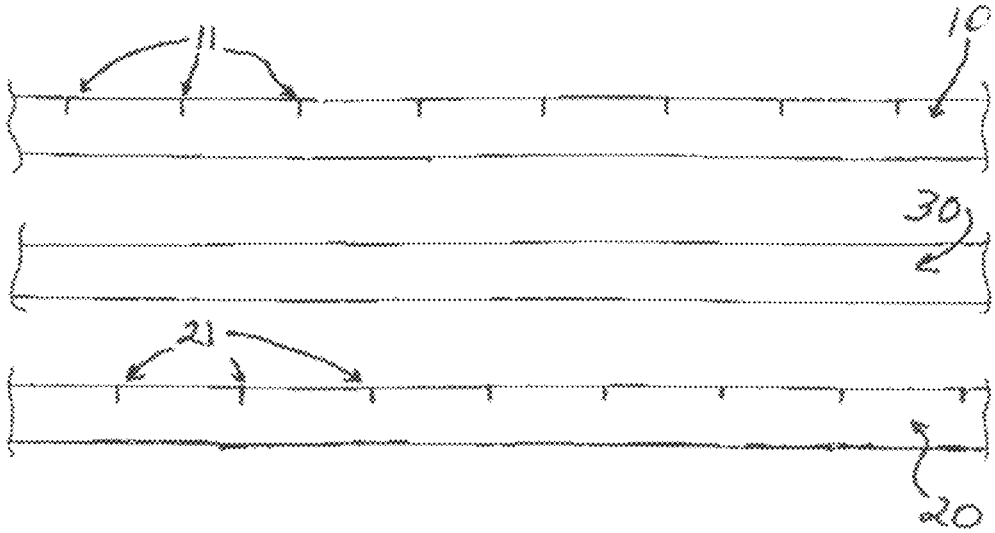
FIG. 4 is a side view showing a stacked arrangement of paper blanks positioned for assembly.

Referring now to FIG. 4, the multi-layered paper-containing product of the present invention is fabricated from at least a top blank 10 and a bottom blank 20. Preferably, one or both of said top blank and bottom blank have sufficient rigidity so as to be shape-sustaining in the sizes normally encountered in plate forming blanks. The top blank 10 is fabricated from a paper product such as, but not limited to, paperboard. Paperboard blanks may be provided with a substantially liquid-impervious coating including an inorganic pigment and/or filler and a water-based, press applied overcoat. The paperboard may be provided with a styrene-butadiene polymer coating, preferably including a carboxylated styrene-butadiene polymer in some embodiments. Furthermore, the paperboard stock material can be impregnated with a sizing material to stiffen the paperboard, especially in the region where the pleats are formed. Typical sizing materials include polyvinyl alcohol, carboxymethyl cellulose, natural gums and resins, sodium silicate, polyvinyl acetate, styrene-butadiene polymer, and the like. A preferred sizing material is starch.

The bottom blank 20 is optionally fabricated from a paper product or paperboard, and can optionally include openings punched or cut therein to vent air or steam during the forming process. Preferably, care is observed that coatings on the lower blank are sufficiently permeable to allow enough steam to escape for proper pressing without formation of bubbles and blisters. In this regard, a coating or glue can be applied in a pattern such that there are uncoated regions between coated regions.

The paperboard blanks can generally have a basis weight of from about 20 lbs to about 400 lbs per 3,000 square foot ream with 80 lbs to 220 lbs per 3,000 square foot ream being preferred.

The blanks can be unscored or scored. But preferably, at least the top blank is scored, and more preferably, both the top blank and the bottom blank are scored. In many applications, it will be convenient to score and blank both the top and bottom blanks from two superposed webs simultaneously. However, score lines can optionally be made in either the upper surface or bottom surface of the top blank 10 and/or bottom blank 20 in accordance with a method described below. For example, referring to FIG. 4, as shown, top blank 10 includes a plurality of score lines 11 made in the upper surface thereof. Bottom blank 20 includes score lines 21 made in the upper surface thereof. However, the top blank 10 and bottom blank 20 can have score lines in their respective bottom surfaces.

Referring again to FIG. 4, the paper-containing product can optionally include one or more intermediate layers 30 positioned between the top blank 10 and bottom blank 20. Intermediate blanks can be fabricated from a wide variety of paper-like materials including paperboard, polymeric films or sheets of thermoplastic polymer including foamed or solid synthetic polymeric resins. The foamed or solid synthetic polymeric material can be selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof, or a foamed or solid polymeric material selected from the group consisting of: polyesters, polystyrenes, polypropylenes, polyethylenes and mixtures thereof. The intermediate layer 30 can be provided at with or without score lines.

Figure 5:
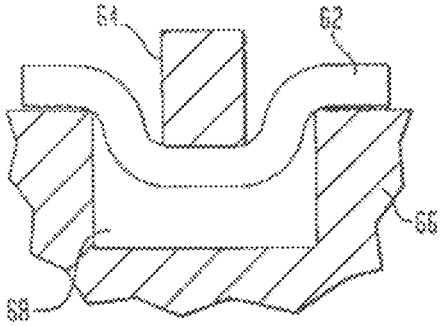
FIGS. 5 through 7 are diagrams illustrating a preferred mode of paper scoring for paperboard, as well as the preferred structure of the resulting pleat in a single ply.
Figure 6:
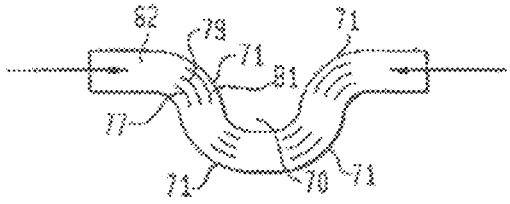
Figure 7:
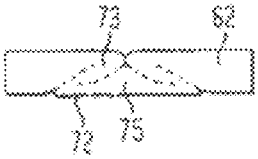
Figure 8:
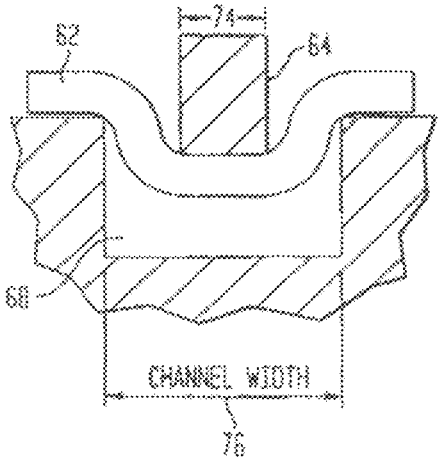
FIG. 8 is a schematic diagram illustrating preferred relative dimensions of a scoring operation showing a single rule, a single paperboard stock and one channel in a scoring press for fabricating scored paperboard blanks used to make the containers of the present invention.

In FIG. 5 there is shown a portion of paperboard stock 62 positioned between a score rule 64 and a scoring counter 66 provided with a channel 68 as would be the case in a scoring press or scoring portion of a pressware forming press. The geometry is such that when the press proceeds reciprocally downwardly and scores blank 62, U-shaped score 70 results. At least incipient internal delamination of the paperboard into lamellae, indicated at 77, 79, and 81, is believed to occur in the sharp corner regions indicated at 71 in FIG. 6. The same reciprocal scoring operation could be performed in a separate press operation to create blanks that are fed and formed subsequently. Alternatively, a rotary scoring and blanking operation may be utilized as is known in the art. When the product is formed in a heated carefully matched die set, a Z-shaped pleat closely adjoins an S-shaped pleat forming a U-shaped pleat 72 with a plurality of lamellae of rebonded paperboard along the pleat in the products formed such that pleats 72 generally have such configuration. When the disruptions forming voids and gaps between the lamellae are totally pressed out and the lamellae rebonded to each other, we refer to the resulting structure as a "substantially integrated fiber structure." The structure of pleat 72 in a single ply is preferably as shown schematically in FIG. 7. During the forming process described hereinafter, we prefer that the paperboard is internally delaminated forming a plurality of lamellae during the scoring and initial phases of the pressing operation as the outer portions of the blank are drawn inwardly, followed, during the completion of the pressing operation, by rebonding of these lamellae under heat and pressure into a substantially integrated fibrous structure generally inseparable into its constituent lamellae. Preferably, the pleat has a thickness generally equal to the circumferentially adjacent areas of the rim and most preferably is somewhat more dense than adjacent areas. Integrated structures of rebonded lamellae are indicated schematically at 73, and 75 in FIG. 7 on either side of paperboard fold lines in the pleat indicated in dashed lines. Referring to FIG. 8, rule 64 typically has a width 74 of 0.028 inches, whereas scoring channel 68 has a width 76 equal to the score rule width 74 plus two paperboard thicknesses and a clearance which may be 0.005 inches or may be from about 0 to about 0.01 inches. In any event, it is preferred to achieve U-shaped symmetrical geometry and internal fiber delamination in the paperboard prior to cutting the blank into the desired shape.

Figure 9:
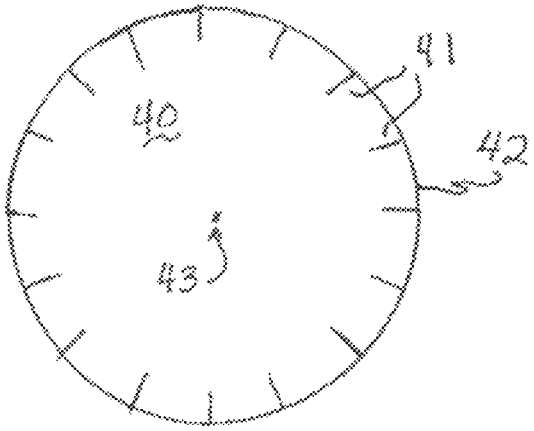
FIG. 9 is a plan view of a circular paper blank.

Referring now to FIG. 9, blank 40 as seen in plan view is circular in shape. Score lines 41, typically around 20 to 80 in number for a nine inch plate, extend around a peripheral portion 42 of the blank and in a generally radial direction with respect to the center point 43 of the blank depending largely upon the size and shape of the blank as well as the depth of the desired product. The peripheral portion 42 is the portion of the blank which is to be formed into a curved configuration by the lamination process described herein.

Figure 10:
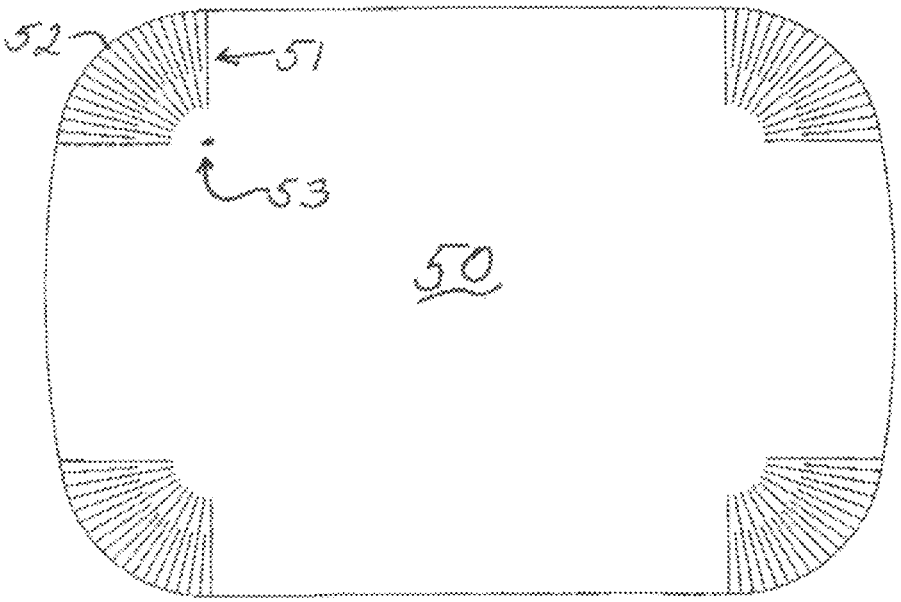
FIG. 10 is a plan view of a rectangular paper blank.

Referring to FIG. 10, blanks can have shapes other than circular. For example, blank 50 is generally rectangular in shape such as for fabricating 9"×13" casserole trays. As can be seen, score lines 51 extend inward from curved corner positions 52 of the blank 50. Moreover, the score lines can optionally be of different lengths such that short score lines alternate with longer score lines. Score lines 51 are radially oriented with respect to a center of curvature 53 for the respective corner portion. The blanks and formed products can have any suitable shape such as circular, oval, rectangular, square, triangular, polygonal, etc., preferably with rounded corners.

The spacing between score lines typically ranges from about 1/16" to 1", more commonly 1/4" to 1/2". A nine inch circular blank typically has about 40 score lines around its peripheral portion. More or fewer score lines or spacing distances outside of the given ranges can be employed whenever appropriate. The score lines can be rectilinear or curved. The spacing between the score lines can be regular or random. Optionally, the spacing of score lines in both the top blank and the bottom blank can be regular but different from each other so as to insure that the score lines of the top blank do not align with the score lines of the bottom blank.

The top and bottom blanks typically each range in thickness from about 5 to 35 mils and can be of about the same or different thickness. Alternatively the top blank can be a lighter weight paper of from about 2 to 10 mils in thickness and the bottom blank can be of a heavier paperboard of from about 4 to 35 mils greater in thickness so long as the total is at least about 10, preferably 12 and still more preferably 14 mils. These ranges are for given for the purpose of illustration. Thicknesses outside of these ranges can be used when suitable. The top blank provides an upper surface on which, for example, comestibles are placed. The top blank can have a functional coating such as water based acrylics, extrusion or laminated films (e.g., polyethylene terephthalate, polypropylene, nylon, etc.) to resist grease or oil and/or for water resistance. The top blank also may optionally include printing on its upper surface, for example, for decorative, promotional, or informational purposes.

Referring to FIGS. 11A and 11B, a formed paper-containing plate 160 is shown having a characteristic diameter D and radius R and which includes a bottom generally planar portion 161, a first annular transition portion 162, a sidewall portion 163, as well as a second annular transition portion 164. The sidewall portion 163 has a generally linear profile 165 between the first annular transition portion 162 and the second annular transition portion 164. An outer arcuate flange portion 167 has an upper convex surface 169. Plate 160 further includes a plurality of pleats 168 extending radially along the outer peripheral portion of the plate from the first transitional portion 162 to the circumferential edge 166.

Figure 12A:
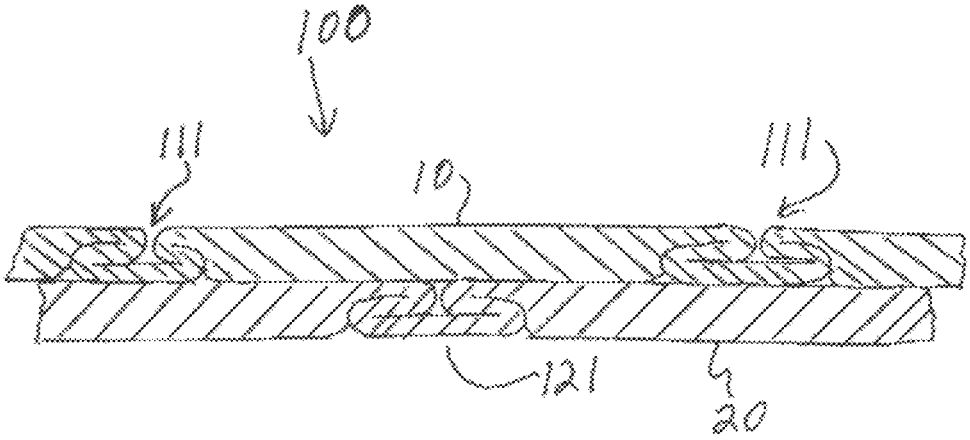
FIG. 12A is a sectional view showing an arrangement of pleats resulting from offset score lines in the layers of material.
Figure 12B:
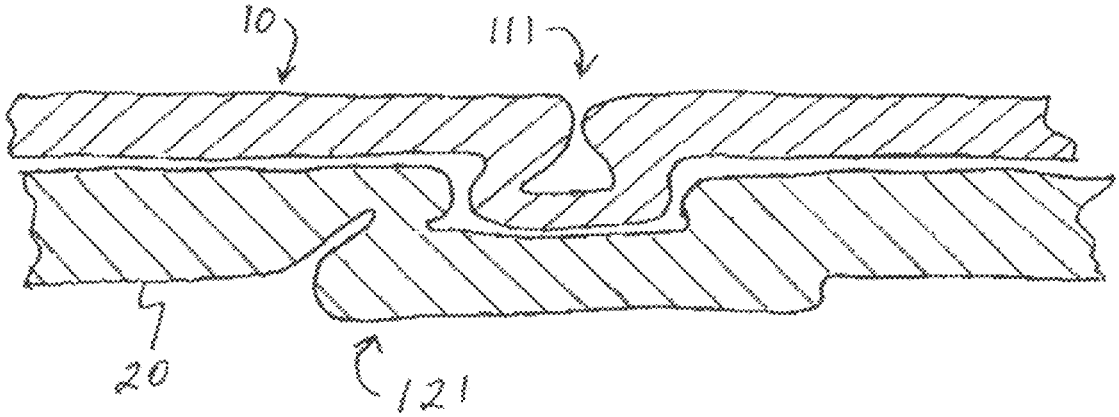
FIG. 12B is a sectional view showing an arrangement of pleats resulting when the score lines are aligned in the layers of material.

A significant feature of the invention is that the pleats of one layer do not interleave with the pleats of the adjacent layer but rather the folds forming the pleat are in staggered arrangement so that the folds forming the pleats in one layer are not generally directly above or below the folds forming the pleats in the other. By this it is meant that in any vertical line extending perpendicular to the layers, folded portion of an upper layer are not generally directly above the pleated portion of the layer below it in at least a plurality of the pleats, preferably a plurality of the folded regions are in staggered array between the layers, still more preferably this arrangement will be found in more than 60 percent of the pleats and most preferably more than 90 percent of the pleats. This holds true whether or not the pleats of the top and bottom layers (or intermediate layers, if present) are aligned. For example, referring to FIG. 12A, a plate 100 composed of a top layer 10 and a bottom layer 20 includes pleats 111 in the top layer 10 and pleats 121 in the bottom layer 20. However, pleats 111 are offset from pleats 121 and, therefore, do not interleave. As shown in FIG. 12B, pleats 111 and 121 are aligned rather than offset. Nevertheless, pleats 111 and 121 still do not interleave with each other as the folded regions forming the pleats in the upper blank are not directly above the folds forming the pleats in the lower blank. No folded portion of the pleated portion in pleat 121 is positioned above a folded portion in pleat 111 on any vertical line. The absence of interleaving enables the final product plate to retain superior strength and stiffness under relatively heavy loads with less likelihood of delamination, hinging, or other mechanical failures at the pleats, particularly as compared to conventional plates under conditions where moisture and grease are present.

To facilitate the formation of non-interleaving pleats during the in-die lamination procedure, measures may be taken to make it possible for the different layers to pleat somewhat independently of each other. That is, the adjacent surfaces of the layers are preferably not overly firmly bonded together making it possible for them to slip or slide relative to each other during the forming process so that only when the plate is completely formed are the layers firmly locked together. In other words, during the forming phase of the in-die lamination process, the blanks are preferably relatively lightly clamped as the dies are moving towards each other, thereby allowing the individual blanks to form incipient pleats relatively independently of each other. When the dies are fully closed during the second phase of the process the blanks are secured to each other, usually by means of an intermediate adhesive or other bonding agent, advantageously one which is activated by the heat or steam of the forming process. Suitable activatable adhesives may include melt-activated adhesives having a melting point of from greater than 75° C. up to about 200° C., for example.

The intermediate activatable adhesive or other activatable bonding agent is preferably applied to the paperboard either as a coating or a size and is dried during its manufacture, or press applied to the paperboard and dried during a subsequent application. Alternatively, the activatable adhesive may be applied just prior to forming. In one embodiment, the activatable adhesive or activatable bonding agent is preferably thermoplastic in nature and can be heat softened to laminate the layers together during the heated forming operation and subsequent cooling. Alternatively, it may also be water based and rewet during the forming operation as the moisture in the paperboard is heated and then cooled.

Manufacture of a paper product can be accomplished in accordance with the following procedure. First, two or more webs of cellulosic material, such as paperboard or other paper material, are fed into a forming press, scored, and cut, either singly or simultaneously, into flat blanks having a circular, quadrangular or other shaped periphery depending on the product to be formed. At least one of the webs of porous material will be typically pre-moistened with water prior to being fed into the forming press. The paper product includes a top blank, and a bottom blank. One or more intermediate blanks may optionally be included and positioned between the top and bottom blanks. The top blank provides a top surface on which, for example, comestibles are placed. The bottom blank serves as a base.

Because of the intended end use of the products, the paperboard stock is typically impregnated with starch and coated on one side with a liquid-proof layer or layers comprising a press-applied, water-based coating applied over the inorganic pigment typically applied to the board during manufacturing. In other cases, the coating applied may substitute for the pigment, as described in U.S. Pat. No. 6,270,577 to Sandstrom et al. In addition, for esthetic reasons, the paperboard stock is often initially printed before being coated. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include multiple, usually two, pigment (kaolin or clay) containing layers, with a binder, of 3 lbs/3000 $ft^2$ ream or so followed by two acrylic layers of about 0.5-1 lbs/3000 $ft^2$ ream. The layers are applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream.

Carboxylated styrene-butadiene resins and the like may be used with or without filler if so desired.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising the latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in Kirk-Othmer, *Encyclopedia of Chemical Technology*, Third Edition, Vol. 17, pp. 798, 799, 815, 831-836, which is incorporated herein by reference. Preferably the pigment is selected from the group consisting of kaolin clay and conventional delaminated coating clay. An available delaminated coating clay is 'HYDRAPRINT" slurry, supplied as a dispersion with a slurry solids content of about 68%. "HYDRAPRINT" slurry is a trademark of Huber. The layer comprising a latex may also contain other additives that are well known in the art to enhance the properties of coated paperboard. By way of example, suitable additives include dispersants, lubricants, defoamers, film-formers, antifoamers and crosslinkers. By way of example, "DISPEX N-40" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercap. By way of example, "Foamaster DF-177NS" is one suitable defoamer. "Foamaster DF-122 NS" is a trademark of Henkel. In a preferred embodiment, the coating comprises multiple layers that each comprise a latex.

The top blank can be of a higher basis weight than the bottom blank and can be of higher quality, particularly if it happens that clay coated board is more economical in heavier weights. Paradoxically, it sometimes occurs that clay coated board is more expensive in lighter weights than heavier. The top blank may also optionally include printing on its top surface, for example, for decorative purposes.

A glue or other type of bonding agent may be applied to the top surface of the bottom blank (or the bottom surface of the top blank) to secure the top and bottom blanks in intimate contact when formed and laminated together. For example, a pattern of discrete regions of adhesive could be applied in the form of an array of dots, a grid of intersecting lines or other convenient discontinuous patterns. Suitable bonding agents include, for example, styrene-butadiene rubber, polyethylene, polyvinyl acetate and copolymers thereof, ethylene vinyl acetate polymers and copolymers, polyvinyl chloride and copolymers thereof, polyvinyl ethers, polyvinylidene chloride and copolymers thereof, starch, dextrin, gums, glue, albumin, casein, sodium carboxymethylcellulose, polyvinyl alcohol, rosin esters, polyamides, and acrylic based bonding agents such as acrylate and methacrylate polymers, as well as adhesives, glues or other bonding agents known in the art. For example, the bonding agent can be a polymer coating (e.g., polyethylene) which melts under processing conditions to cause adhesion. The bonding agent optionally may be applied to only a portion of the top surface of the bottom blank or in a pattern rather than to the entire top surface, for example, to facilitate the escape of steam which can be generated in processing and which can cause blistering of the final product. The bonding agent is preferably dried prior to the placement of the paper blanks in the die set and wetted or liquefied only during the forming process so as to allow portions of the blanks to slip or slide circumferentially relative to each other to permit the blanks to pleat independently of each other. Alternatively, the blanks can be "tacked" to each other with an adhesive in order to maintain their relative position as long as those portions of the blanks which undergo pleating are not so firmly pre-bonded that they are unable to slide and pleat independently of the adjacent blanks. In one embodiment, the blanks are tacked together only in the center. In another, the blanks may be tacked together only lightly even in the rim and sidewall areas. Alternatively, the bonding agent can be applied to the blank just prior to forming.

The top and bottom blanks typically each individually range in thickness from about 10 to 35 mils and can be of the same or different thickness. For example, the top and bottom blanks can be made from paperboard having a thickness of from about 10-35 mils. Alternatively, for example, the top blank can be a lighter weight paper material of from about 2 to 7 mils and the bottom blank can be a heavier paperboard of from about 10 to 35 mils in thickness. The ranges of thickness given herein are for purposes of illustration. Thicknesses outside of these ranges can be used when suitable.

In one embodiment, the blanks are formed separately then fed down a chute into the forming die set. In this case, the blanks may be tacked together with local gluing, as mentioned above, as long as the pleating area is not so firmly bonded as to interfere with the independent formation of pleats as described above. As mentioned above, in one embodiment the top and bottom blanks are positioned such that the respective score lines are offset from each other. Alternatively, the respective score lines can be aligned. In either case the pleats of the top blank are allowed to form independently of the pleats of the bottom blank because the pleating areas of blanks 10 and 20 are not firmly pre-bonded to each other before forming. Rather, the blanks are preferably in contact with each other but not firmly bonded together until formed and laminated in the die. The die set presses the blanks into the final product shape under suitable processing conditions of pressure, heat and dwell time. For example, suitable temperatures range from about 200° F. to about 450° F., preferably from about 250° F. to about 400° F. Suitable forming forces range from about 4,000 to about 22,000 pounds, wherein 6,000 to 12,000 pounds is a typical, commonly used range.

In yet another embodiment, the top and bottom blanks can be separately and individually pleated and formed in separate forming operations, then bonded together with adhesive or other bonding agent in a subsequent pressing operation.

Figure 13:
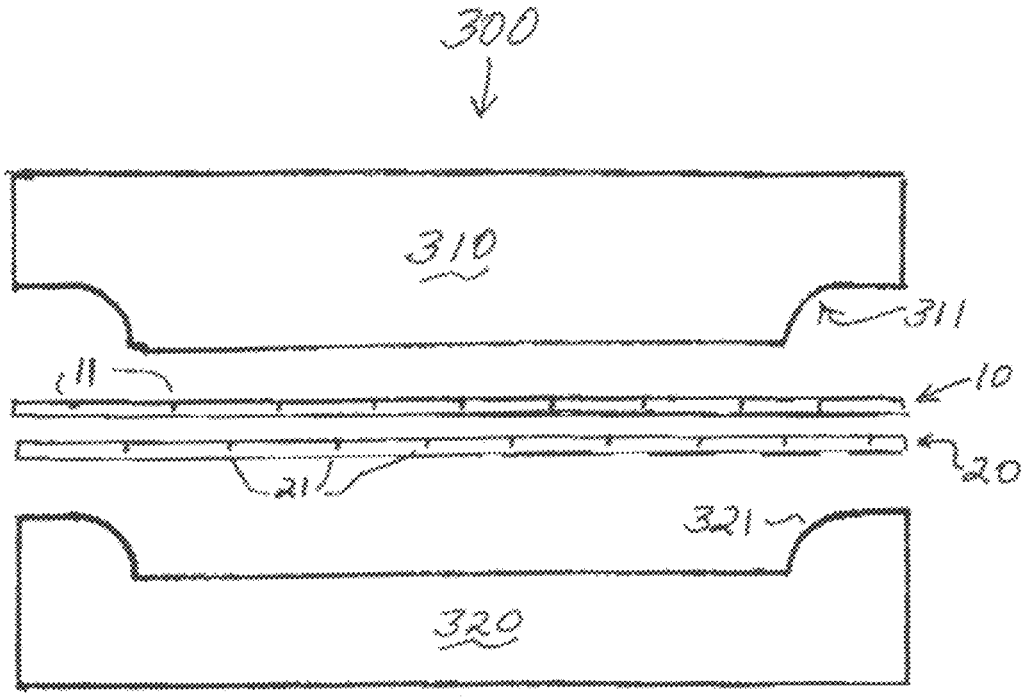
FIG. 13 is a diagrammatic view of a die arrangement with top and bottom blanks positioned for forming.

Referring to FIG. 13, a die assembly 300 includes a male die 310 and a female die 320, having curved portions 311 and 321, respectively, which will form corresponding portions of top blank 10 and bottom blank 20 into curved configurations. Preferably, the forming clearances between the top and bottom dies are carefully controlled to facilitate reformation of the laminated portions of pleats into substantially integrated fiber structures during the forming process. The scored top (scores 11) and bottom (scores 21) blanks are positioned between the male and female dies, which are then brought together under suitable processing conditions to form a paper product having a two-ply layered unitary structure with independently formed pleats in the top blank and the bottom blank. In the case of the present invention, it is preferable to contour the dies such that the bottom is pressed with pressure that is generally comparable to that applied to the sidewall and rims. Generally substantially uniform clearances may be used.

Figure 14:
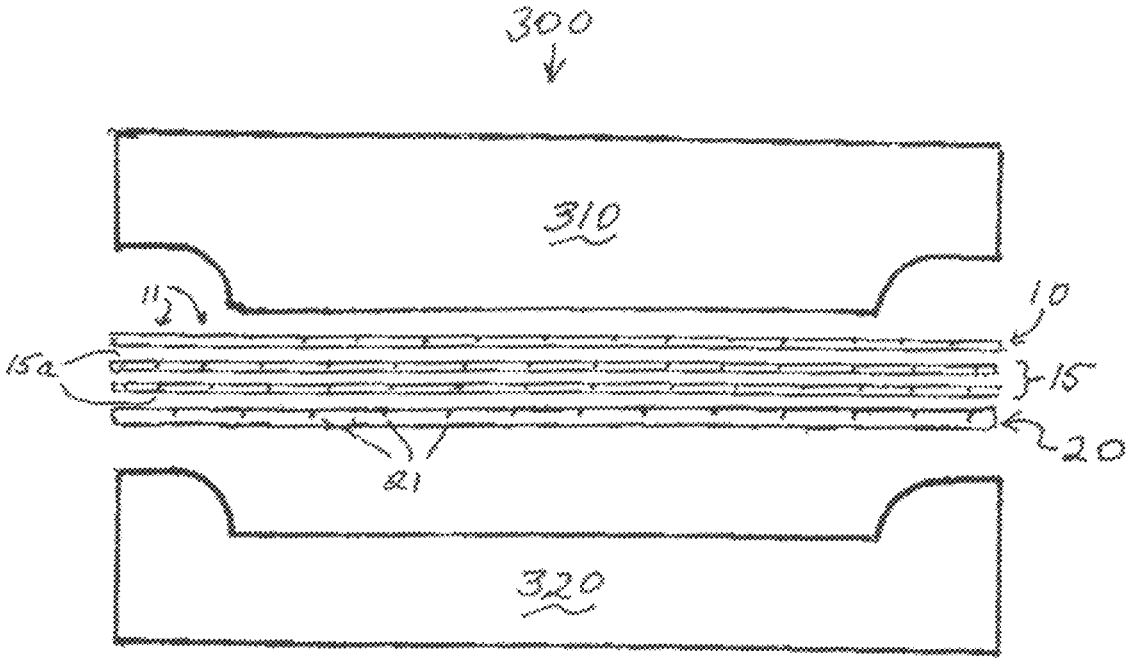
FIG. 14 is a diagrammatic view of a die arrangement with top and bottom paper blanks and intermediate blanks positioned for forming into a paper product.

Referring to FIG. 14, one or more scored intermediate paper blanks 15 can be positioned between the top blank 10 and the bottom blank 20 to form a multi-ply paper product. Intermediate paper blanks 15 preferably also have score lines 15*a*. Preferably, an activatable bonding agent is applied to the surfaces of the respective blanks such that each interface between the blanks will have activatable bonding agent.

Referring now to FIGS. 15-19, a die set wherein the upper assembly includes a segmented punch member and is also provided with a contoured upper pressure ring is advantageously employed in carrying out the present invention. Pleating control is achieved by lightly clamping the paperboard blank about a substantial portion of its outer portion as the blank is pulled into the die set and the pleats are formed. It is important during this process to avoid sharp corners about the outer flange because interaction of sharp features of the die with the paperboard blank may result in off-center forming. One such apparatus is illustrated schematically in FIGS. 15-19.

A segmented matched die set 80 includes a punch 82 as well as a die 84. Punch 82 is provided with spring loaded articulated knock-out 86 urged downwardly by a spring (not shown), punch forming contour 88 defined on the lower surface thereof, as well as a pressure ring 92 encompassing punch forming contour 88. Optionally, a non-articulated knock-out could be used without a spring pre-load. Non-articulated knock-outs are those which do not extend to the container sidewall forming area. Pressure ring 92 is mounted for reciprocating relative motion with respect to the other portions of the punch and is biased downwardly toward die 84 by way of springs such as spring 94. Spring preload is provided by means of several L-shaped brackets that are attached to the pressure ring around its perimeter and contact milled out regions in the punch base. The pressure ring is provided with a forming contour 95 as shown. Die 84 includes a die knock-out 96 and a die base 100 provided with a die forming contour 98.

Figure 15:
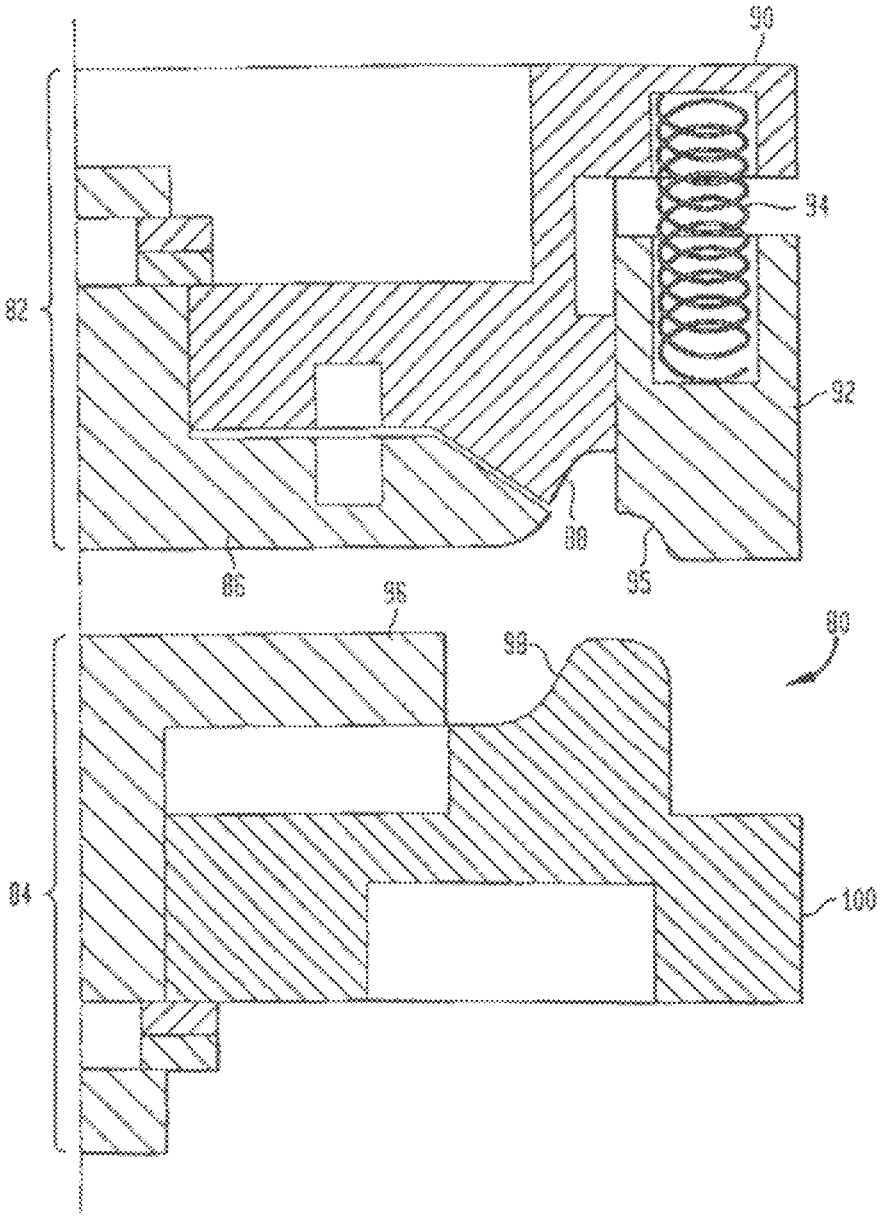
FIGS. 15-19 illustrate the sequential operation of a segmented die set useful for forming paper-containing products of the present invention.
Figure 16:
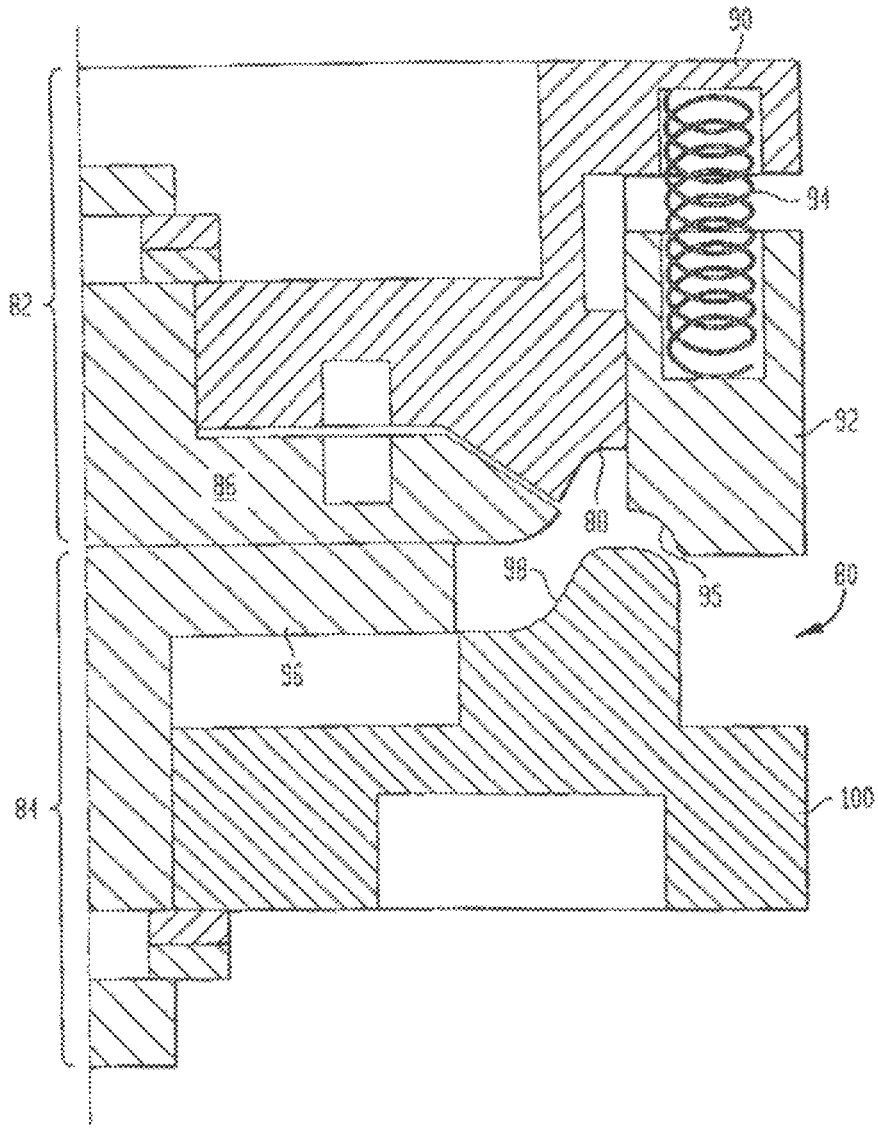
Figure 17:
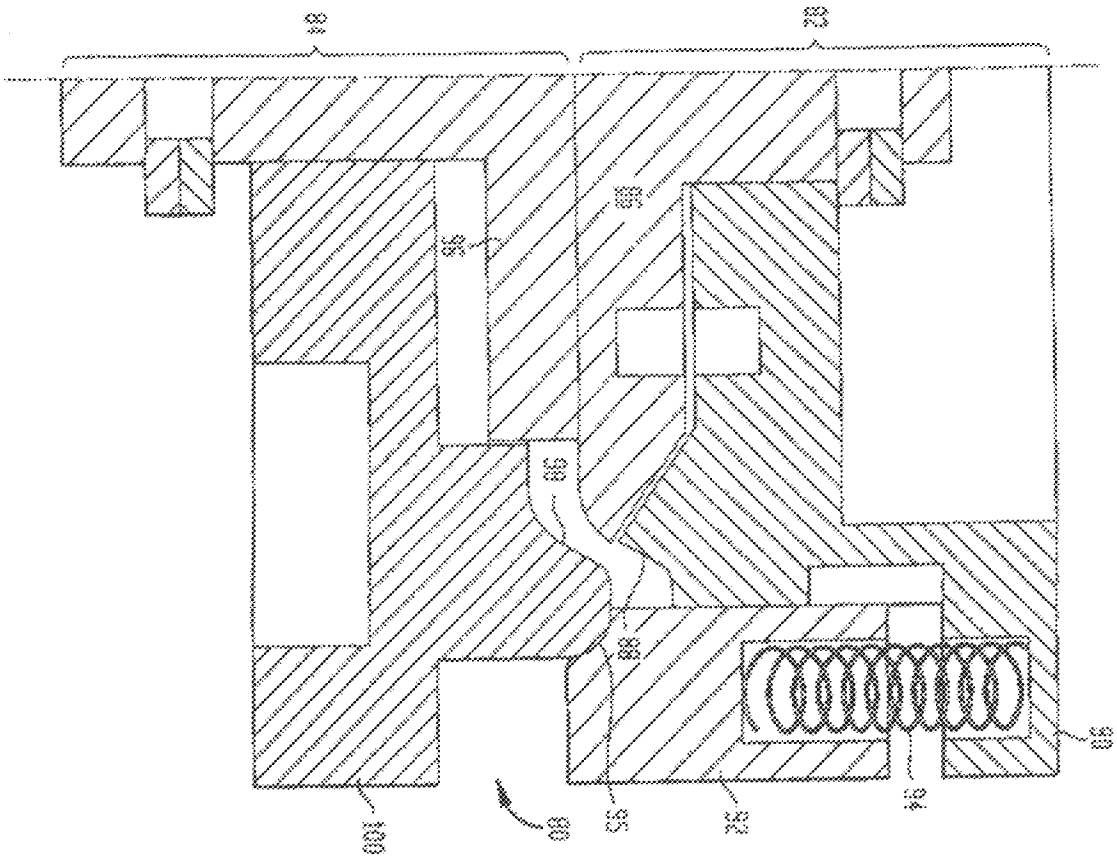
Figure 18:
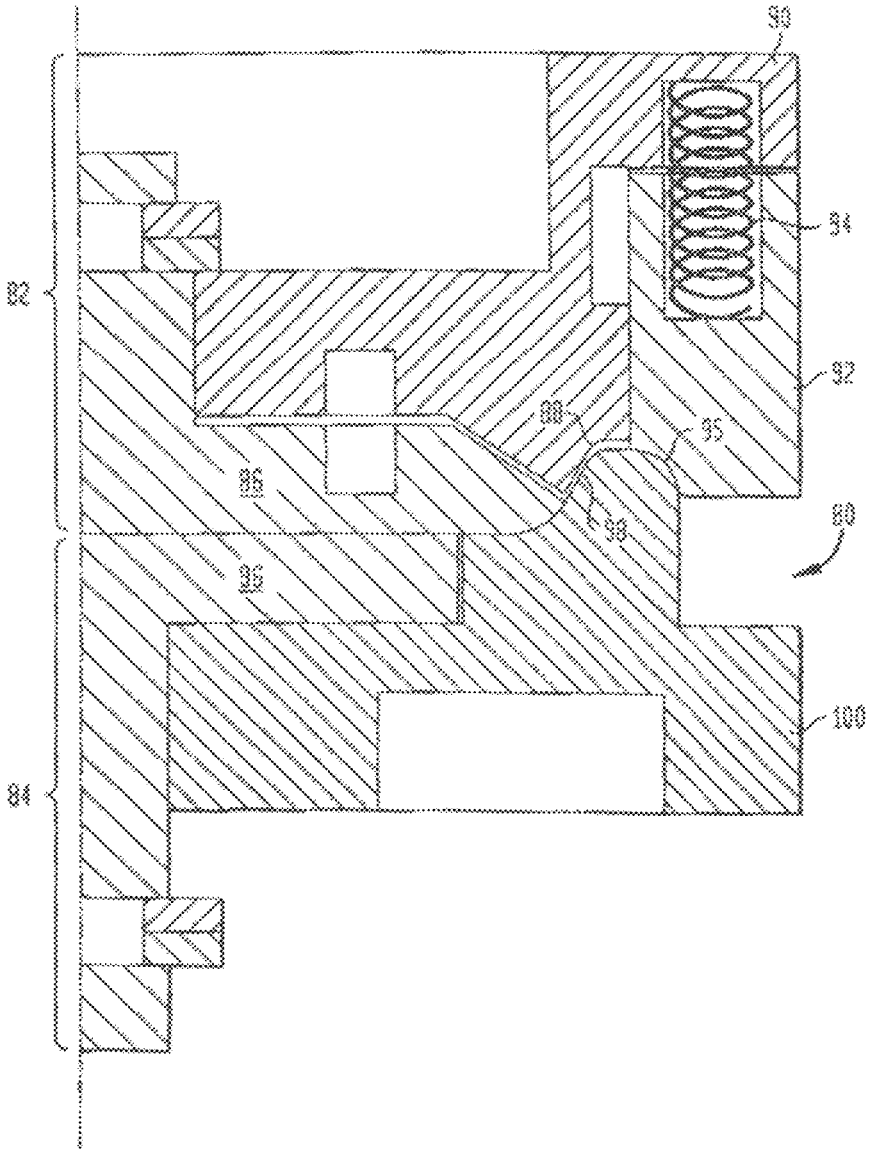
Figure 19:
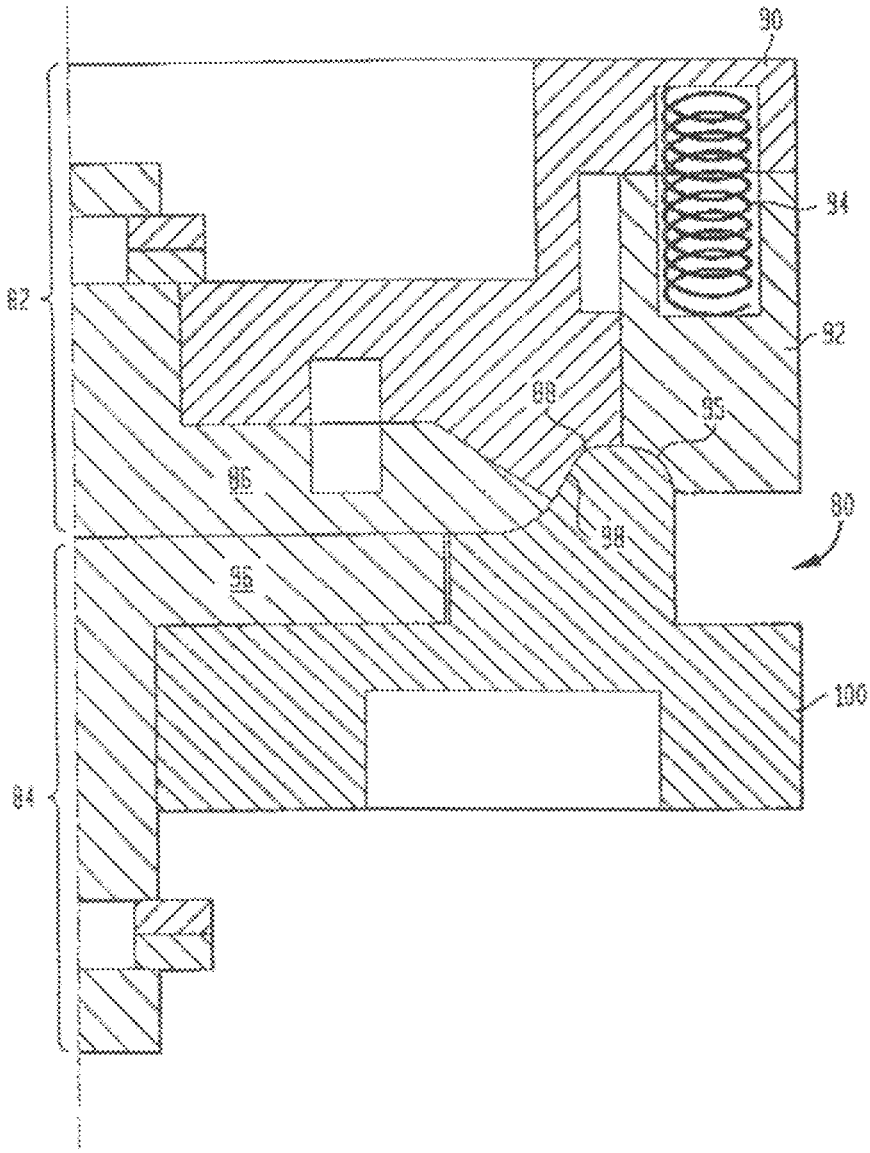

FIGS. 15-19 show sequentially the movement of a die set during forming. In FIG. 15, the die set is fully open as would be the case as a blank is positioned in the die set for forming. In FIG. 16, the die set has advanced such that a blank is gripped between knock-outs 86 and 96. As the process continues as shown in FIG. 17, a blank is clamped lightly between contour 95 of pressure ring 92 and die 84. Thereafter, as shown in FIG. 18, the punch and die continue to advance towards one another as the product is pressed into shape and pleats are formed in the paperboard between the various portions of the die set. Finally, there is shown in FIG. 19 a position where punch 82 and die 84 are fully advanced to conform the blank into the product shape.

On opening, the staging is reversed. Whereas commonly the formed product remains in punch 82, articulated punch knock-out 86 pushes product off of punch forming contour 88 and pressure ring 92 pushes the product out of the punch preferably with air assist.

Alternative tools suitable for making pressed paperboard disposable containers of the invention include a segmented matched die set with an upper pressure ring optionally having a portion of the product profile and a lower draw ring that are allowed to translate during the formation process as controlled by springs with specified spring rates (lbs/in) deflection and preloads. The rings and springs are chosen so as to allow clamping of the blank against the tooling during the formation process allowing a greater distance and time during the forming operation for pleating control. The upper pressure ring springs, spring rates and preloads are sized so that the total force to deflect them from their initial preload state is approximately the same or slightly greater than the full deflection force of the opposing draw ring springs, such that the draw ring springs are ideally fully deflected before the pressure ring springs begin to compress. A relief area may exist on the lower draw ring to reduce the initial clamping force on the paper blank.

In yet another embodiment, a die set 110 including both an upper pressure ring and a lower draw ring is illustrated in schematic profile and forming sequence in FIGS. 20-25. Die set 110 includes a punch 112 and a die 114. Punch 112 is provided with spring loaded articulated knock-out 116 urged downwardly by a spring (not shown) and punch base 120 having punch forming contour 118 defined therein. Optionally, a non-articulated knock-out could be used as noted above. There is provided further a punch base 120 as well as a pressure ring 122. Pressure ring 122 is mounted for reciprocating relative motion with respect to the other portions of the punch and is biased downwardly toward die 114 by way of springs such as spring 124. Spring preload is provided by means of several L-shaped brackets that are attached to the pressure ring around its perimeter and contact milled out regions in the punch base. The pressure ring is provided with a forming contour 125. Die 114 includes a die knock-out 126, a die base 130 provided with a forming contour 128. There is additionally a draw ring 132 which is provided with a relieved surface portion 134 as shown in the various Figures. Draw ring 132 is mounted for relative reciprocating motion with respect to die base 130 and is upwardly biased by springs such as spring 136. Spring preload is provided by means of several L-shaped brackets that are attached to the draw ring around its perimeter and contact milled out regions in the base.

Figure 20:
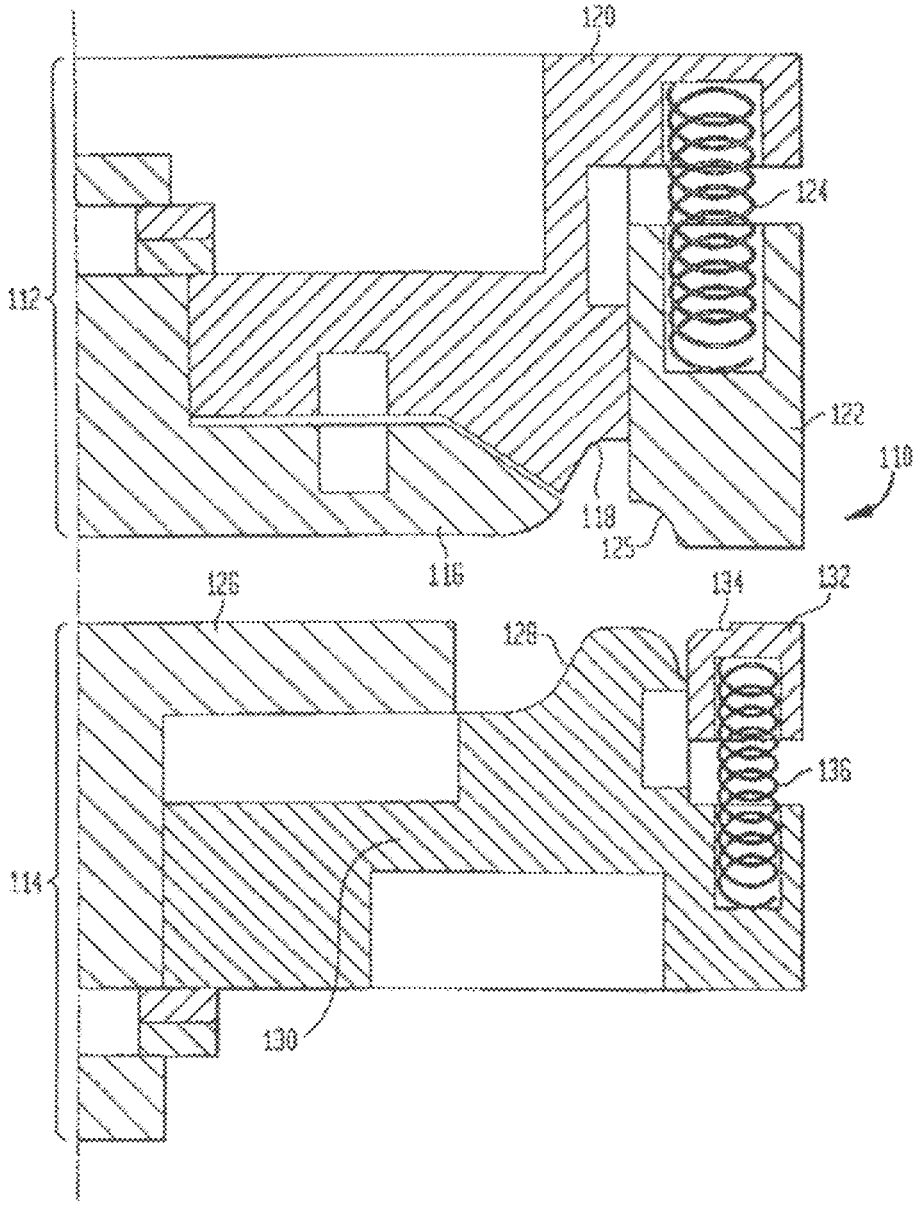
FIGS. 20-25 illustrate the sequential operation of another segmented die set useful for forming paper-containing products of the present invention.
Figure 21:
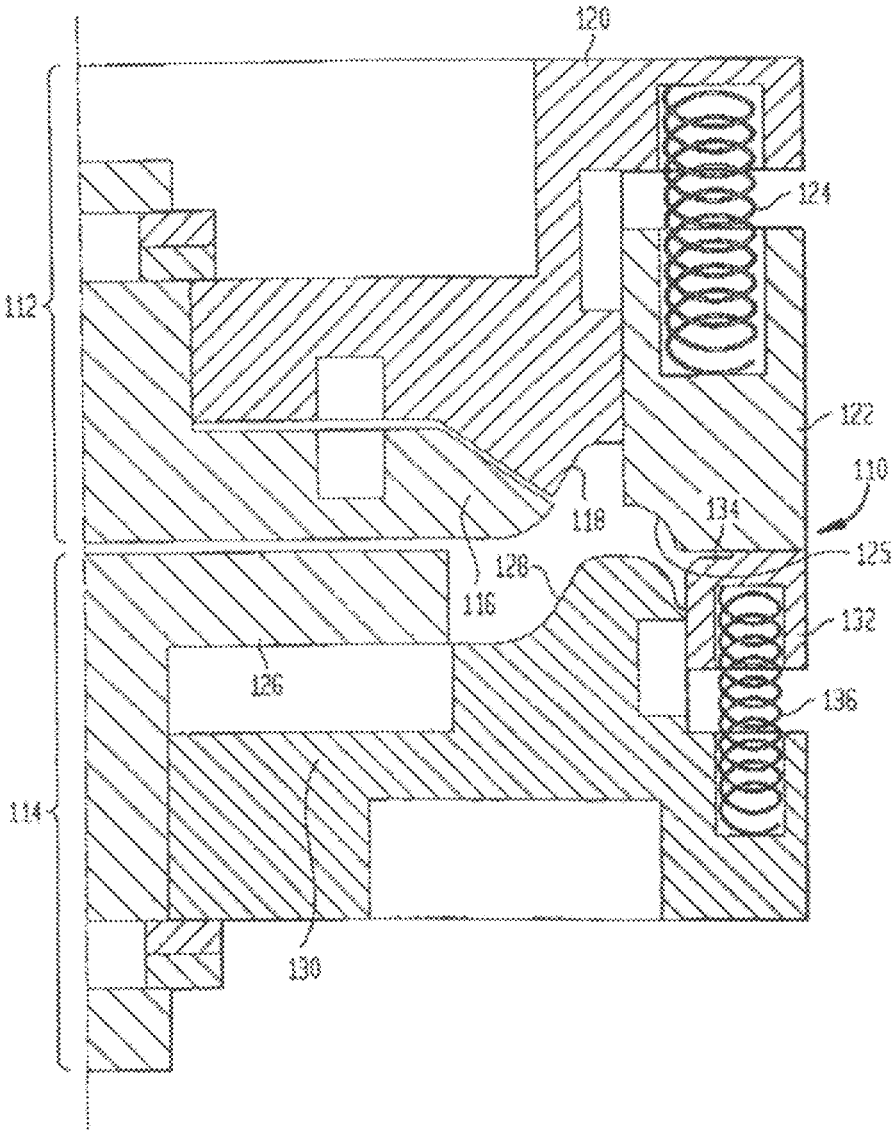
Figure 22:
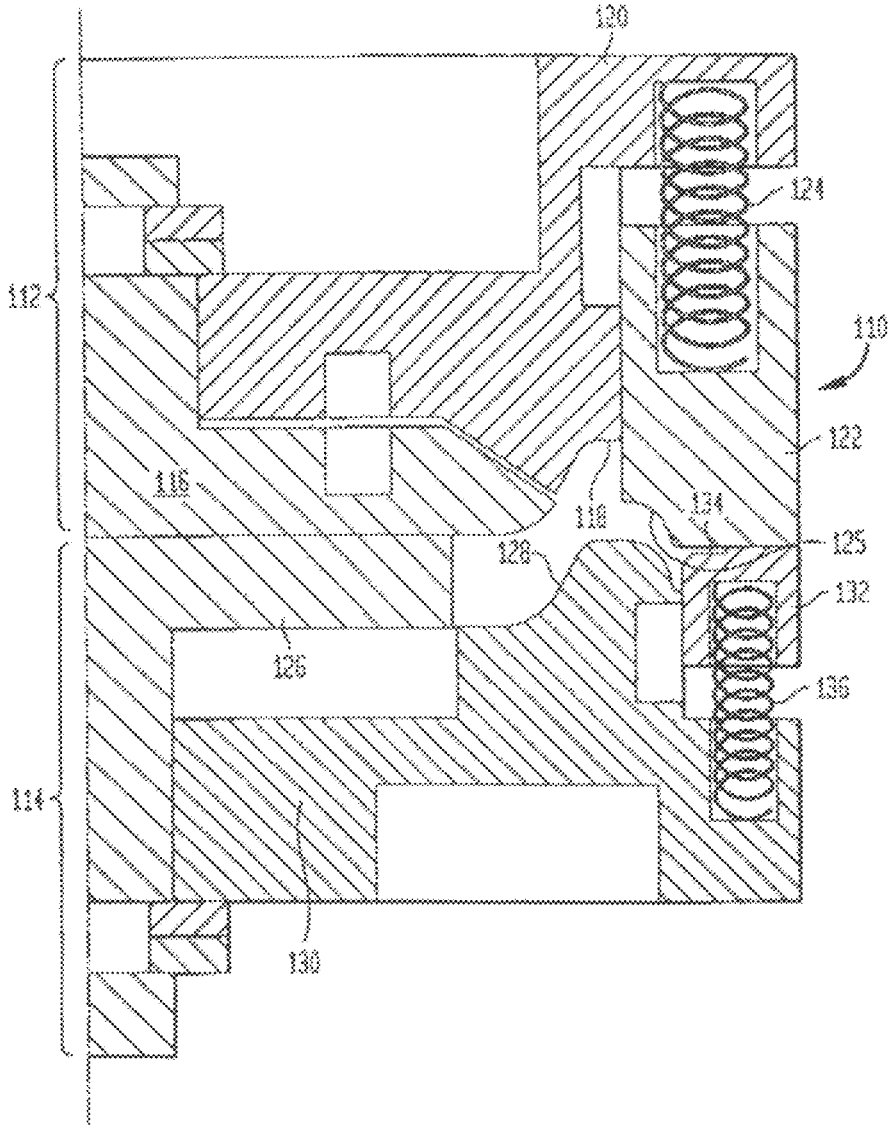
Figure 23:
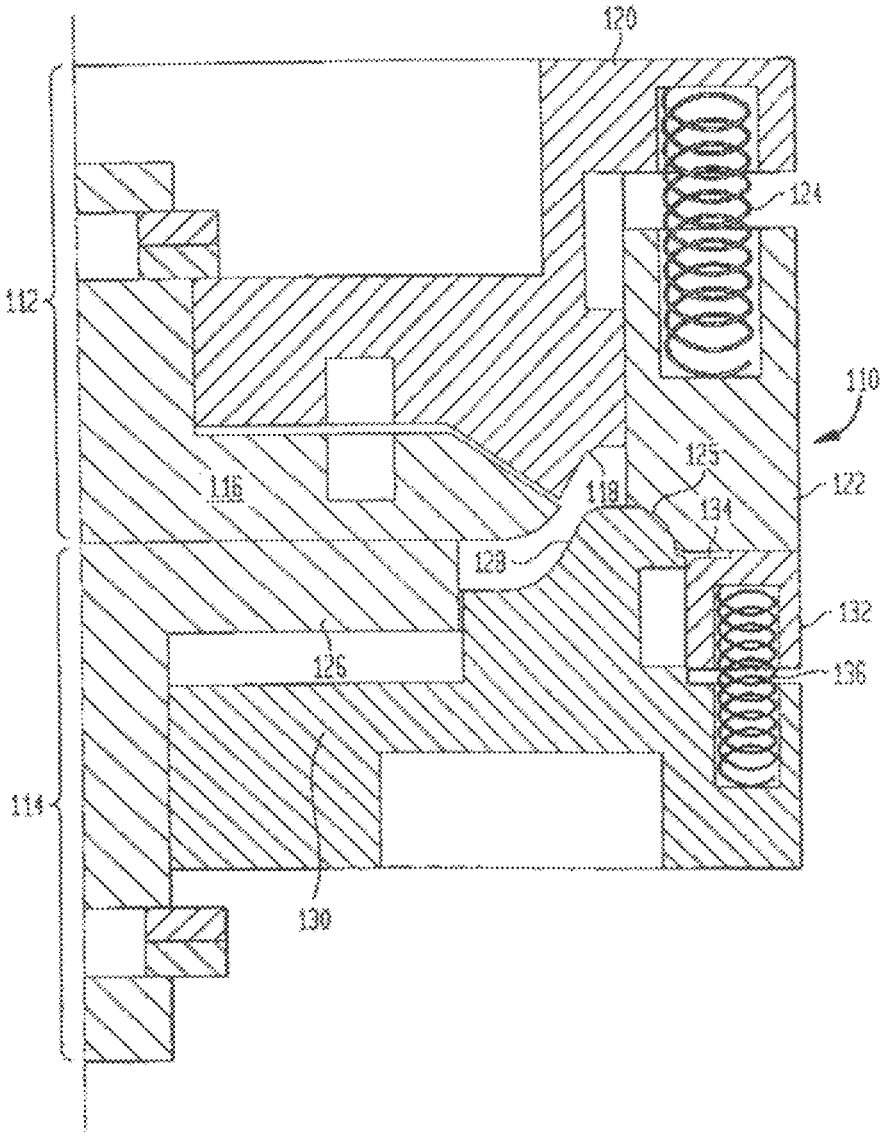
Figure 24:
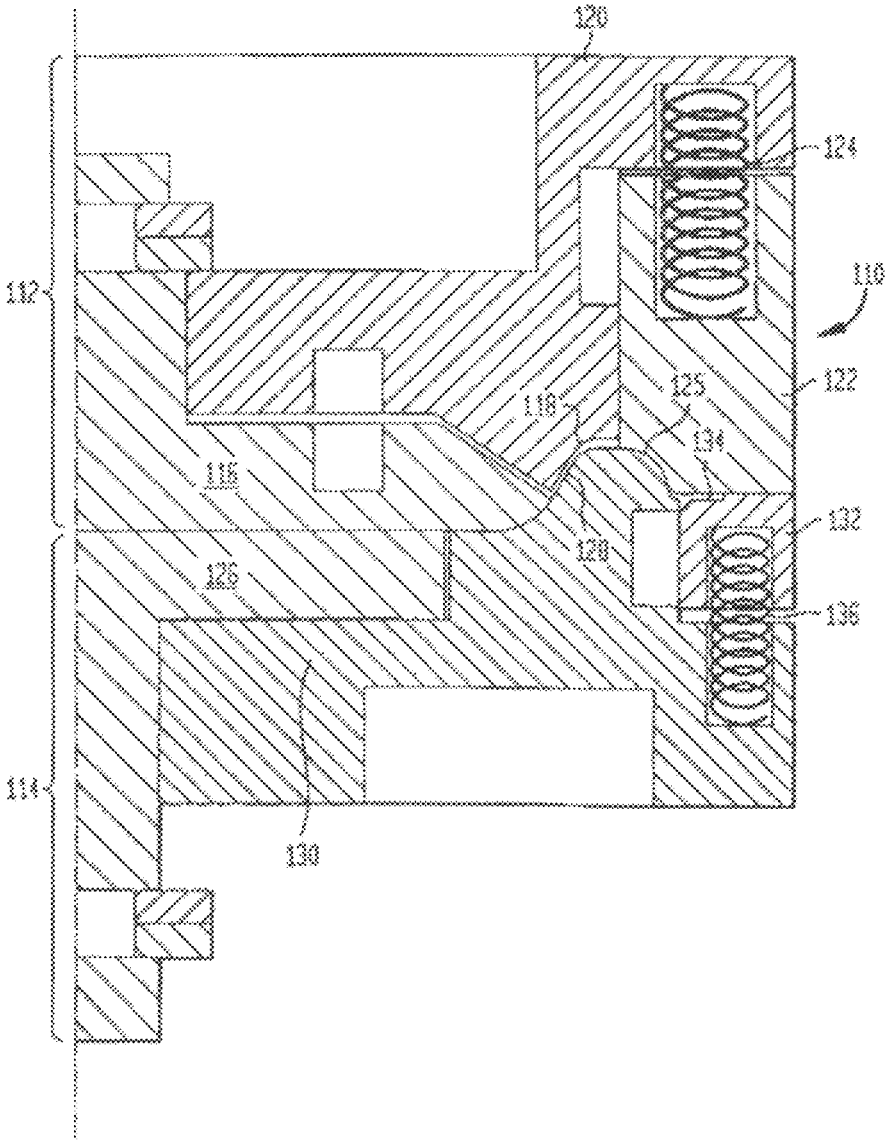
Figure 25:
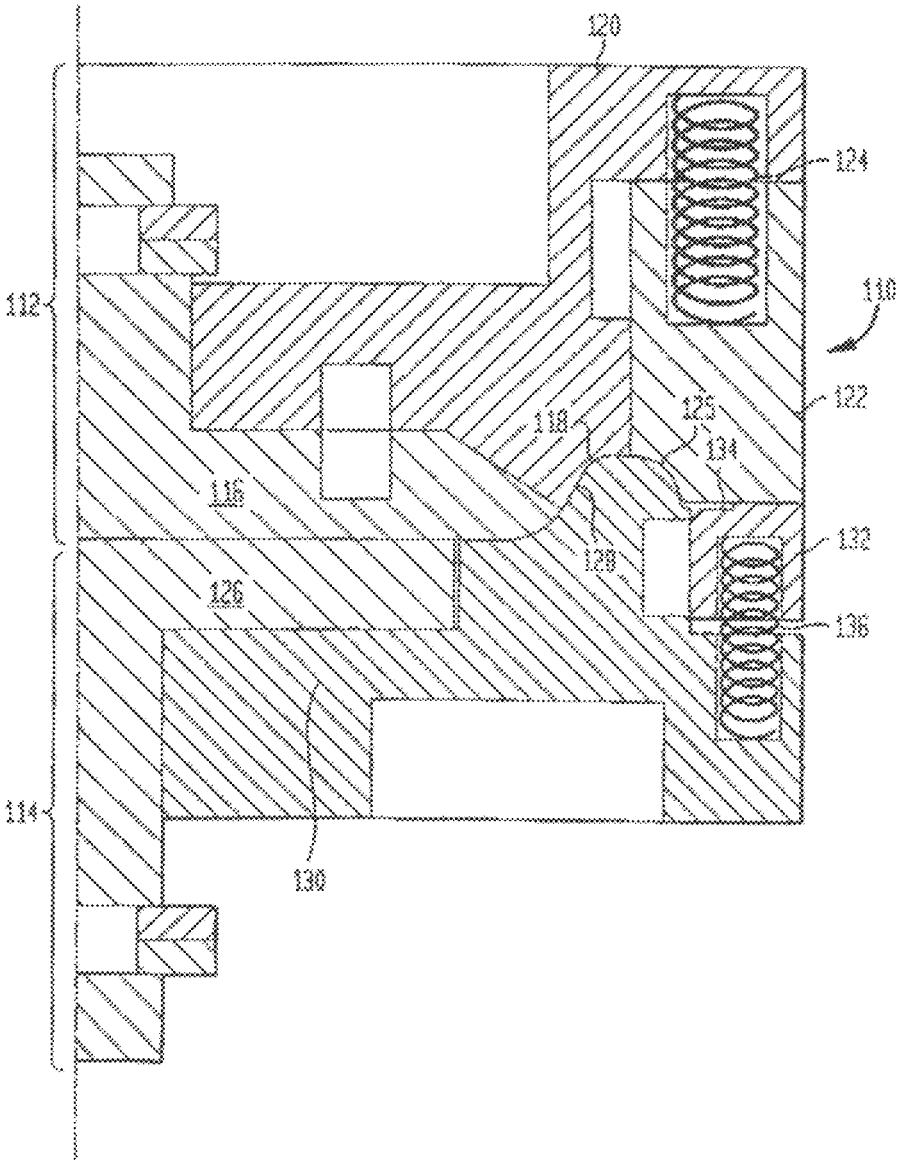

FIG. 20 shows die set 110 in an open position for receiving a blank to be formed. In FIG. 21, the die halves advance and pressure ring 122 and draw ring 132 engage the blank. In FIG. 22, the punch and die further advance so that a blank being formed is gripped between the pressure and draw ring as well as knock-outs 116 and 126. In FIG. 23, the blank is clamped lightly between contour 125 of pressure ring 122 and die 114. The process continues as is shown in FIGS. 24 and 25. Upon opening to remove the product, staging is reversed.

Referring now to FIGS. 26-30 yet another die set 500 is illustrated, wherein die set 500 includes a punch assembly 510. Punch assembly 510 includes a punch base 511, a punch knockout 512 and spring loaded pressure ring 513 operatively associated with the punch base 511 and urged downwardly by a spring (not shown). Die assembly 520 includes a die base 521, and a die knockout 522 and spring loaded draw ring 523 operatively associated with the die base 521 and urged upwardly by a spring (not shown).

Figure 26:
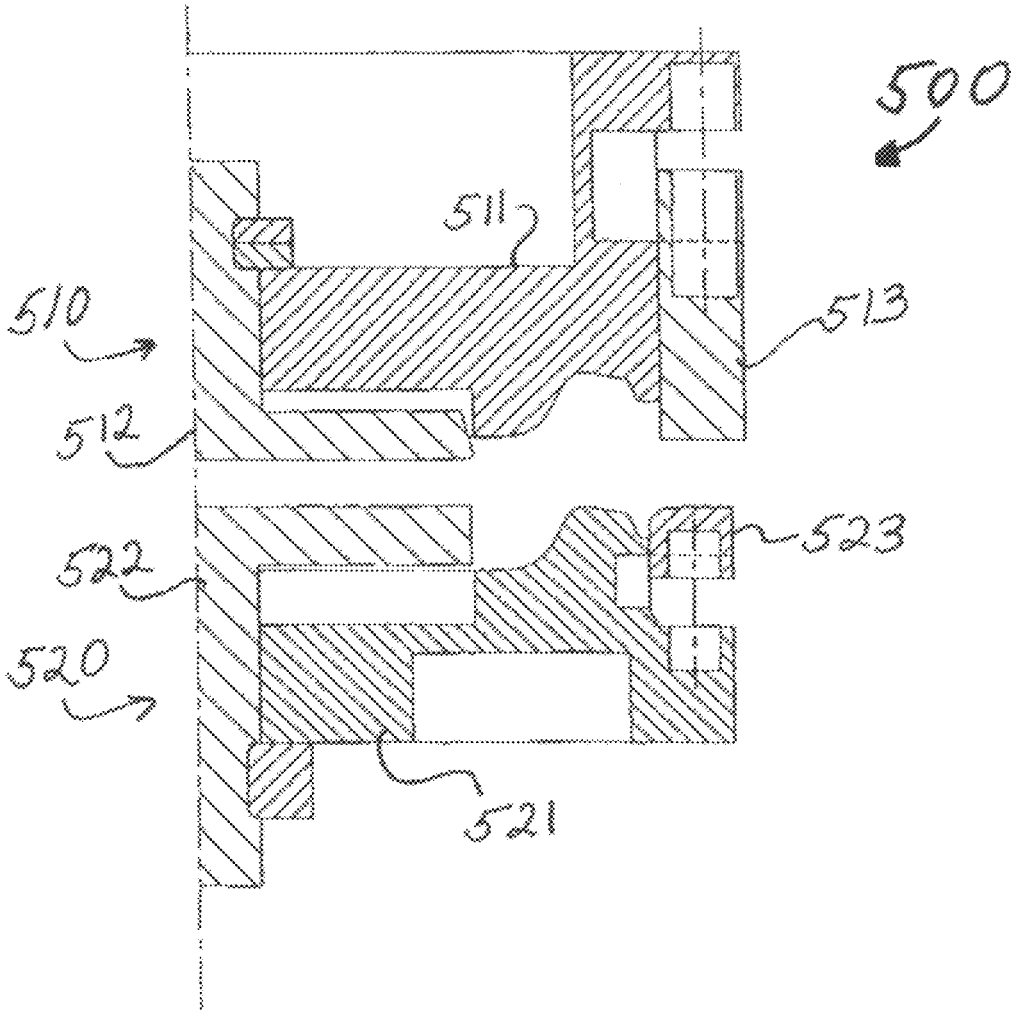
FIGS. 26-30 illustrate the sequential operation of yet another segmented die set useful for forming paper-containing products of the present invention.

FIG. 26 illustrates die set 500 in an open, spaced apart configuration for reception of the paper blanks (not shown) in the gap between the punch assembly 510 and die assembly 520.

Figure 27:
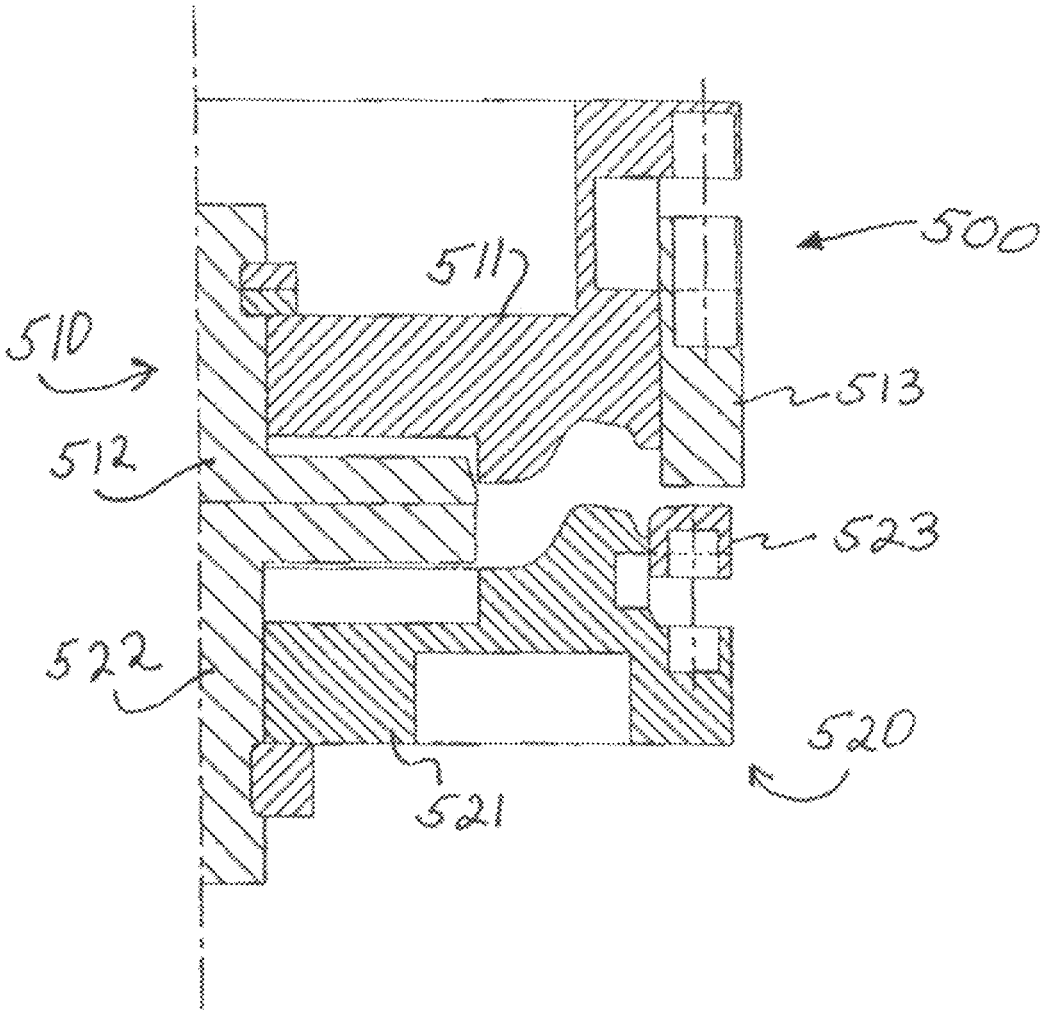

In the next stage, as shown in FIG. 27, the punch assembly 510 is moved toward the die assembly 520. The punch knockout 512 and die knockout 522 first contact the paper blanks disposed between them and clamp the paper blanks in position.

Figure 28:
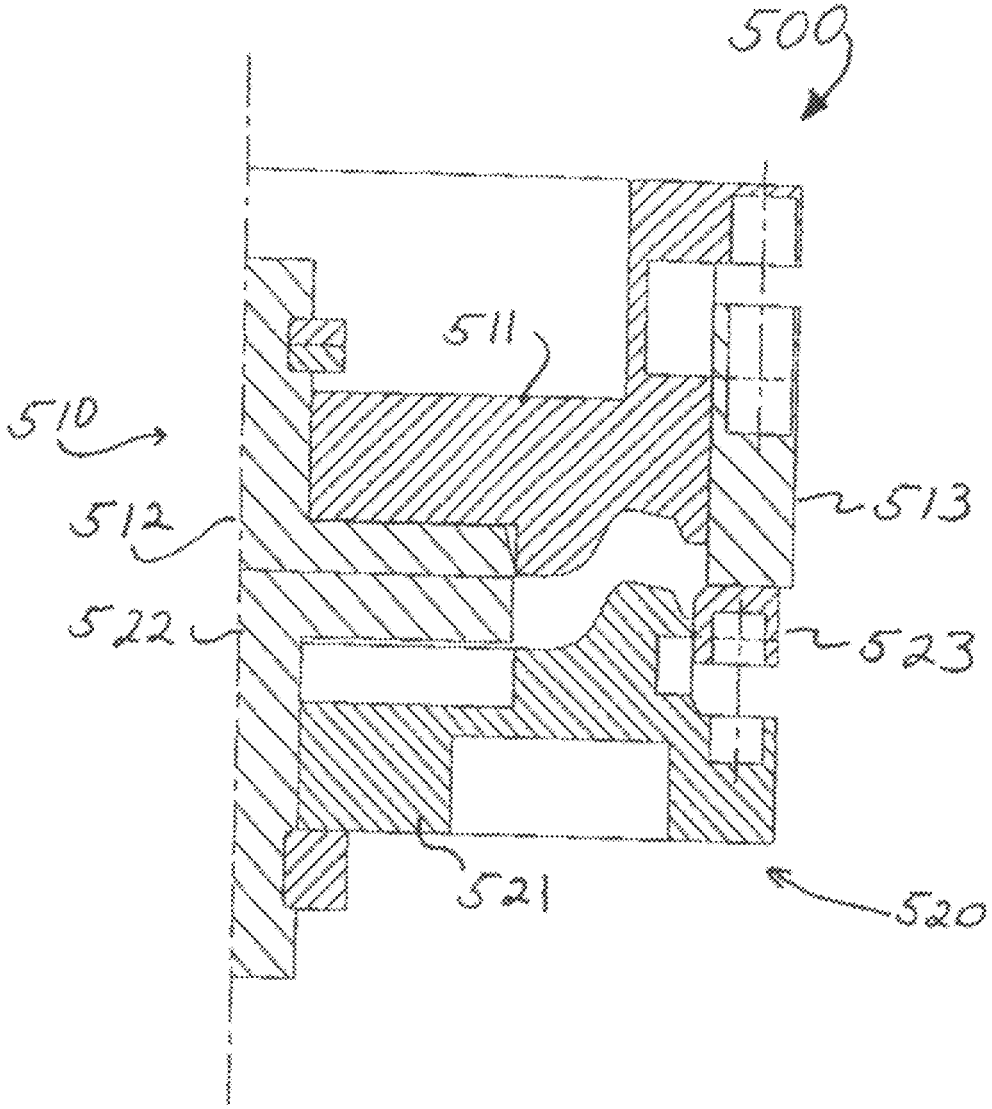

In the next stage, as shown in FIG. 28, the punch assembly is further advanced and pressure ring 513 contact and clamp the peripheral portion of the paper blanks to control pleating. The punch knockout 512 is allowed to slide relative to the punch base 511 to accommodate the advancing movement of the punch base 511 while still maintaining a clamping force on the paper blanks.

Figure 29:
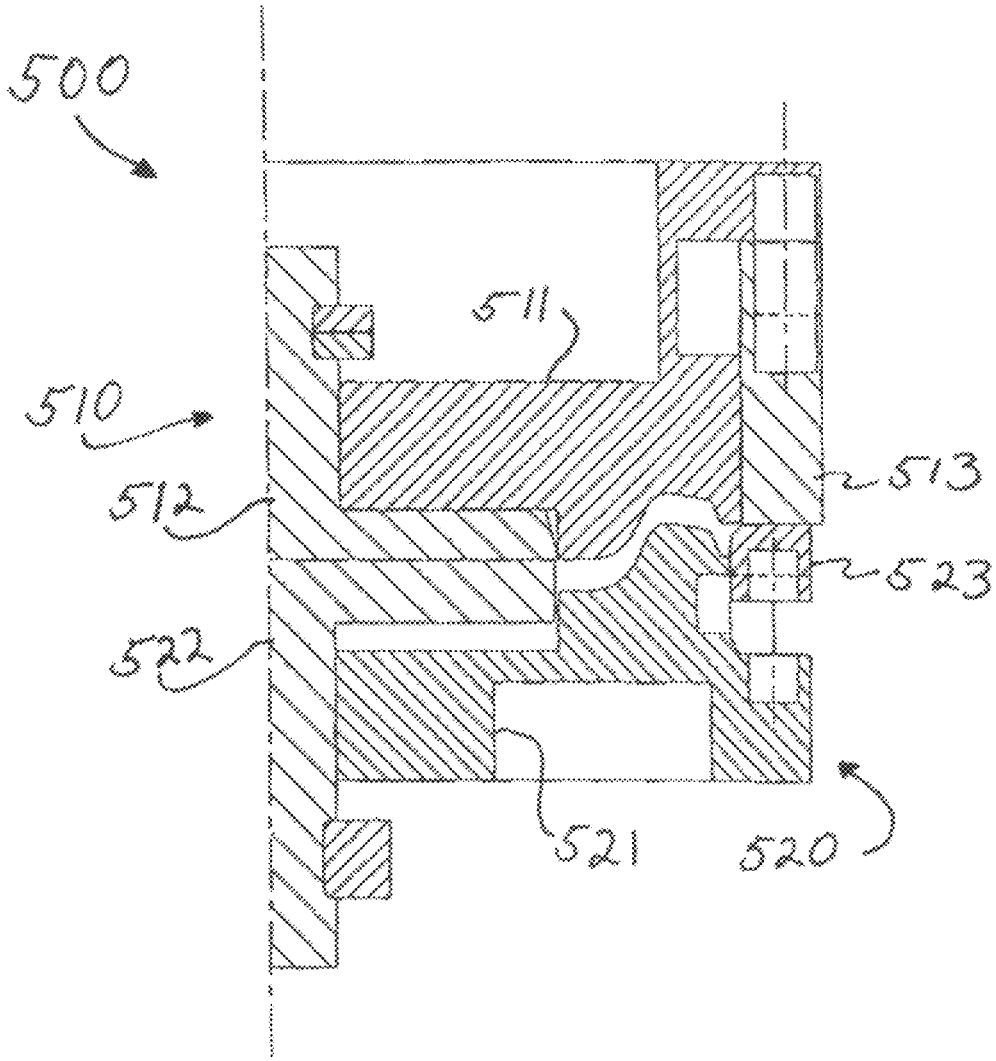

In the next stage, as shown in FIG. 29, as the punch base 511 advances further toward the die base 521, the pressure ring 513 is allowed to slide relative to the punch base 511 against the biasing force of a spring (not shown) in order to accommodate the further advance of the punch base 511. Moreover, the draw ring 523 and die clamp 522 are allowed to slide relative to the die base 521.

Figure 30:
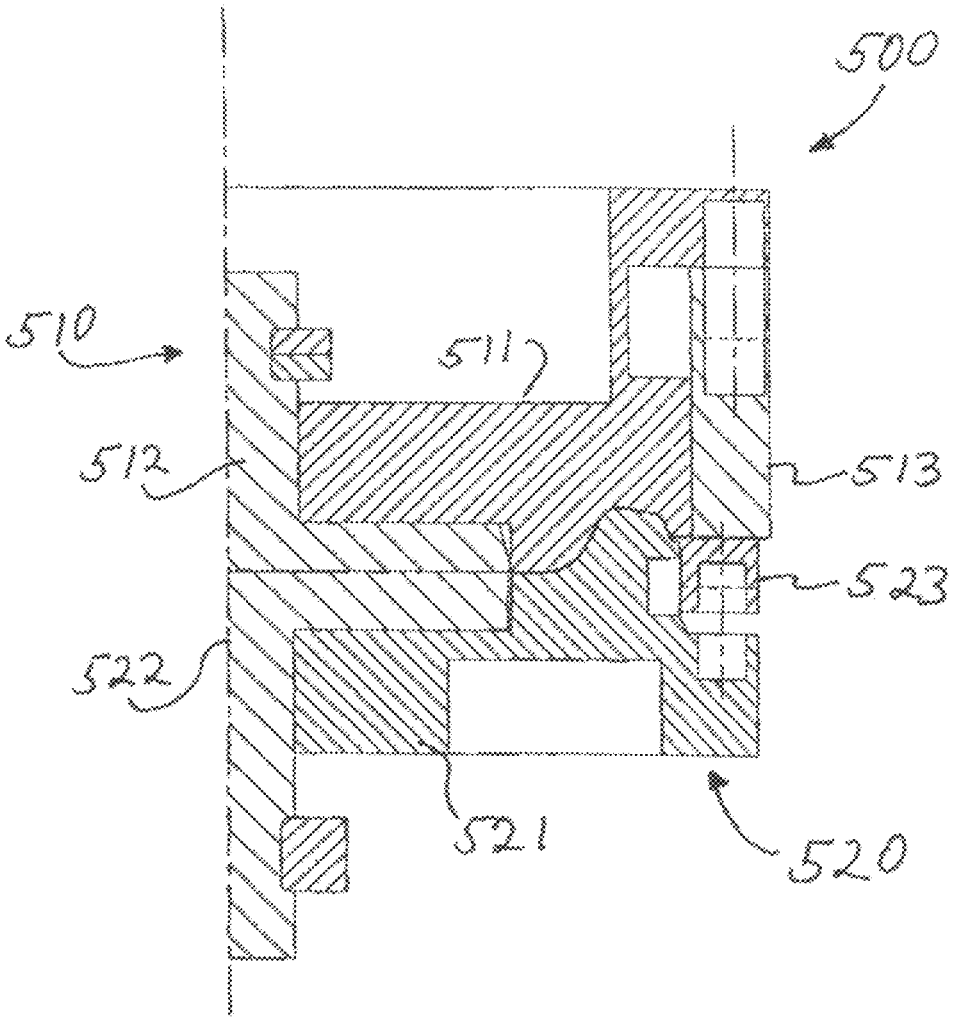

In the next stage, as shown in FIG. 30, the die set 500 is in the fully closed position. The punch base 511 and die base 521 are in close proximity so as to contact and clamp the paper blanks between them. The punch knockout 512, pressure ring 513, die knockout 522 and draw ring 523 are moved relative and draw ring 523 are moved relative to their respective base members such that the overall relative position of the paper blanks is fixed while independent pleating is allowed between the punch base 511 and the die base 521 until the process is fully completed.

Draw and/or pressure rings may include one or more of the features: circular or other shapes designed to match the product shape; external location with respect to the forming die or punch base and die or base contour; stops (rigid or rotating) connected thereto, with an optional adjustment system, to locate the blank prior to formation; cut-out "relief" area that is approximately the same depth as the single or multiple paperboard caliper to provide a reduced clamp force before pleating starts to occur—this provides initial pleating control before the arcuate outer area contacts and provides final pleating control although the draw ring technique is preferred as it is believed to provide advantages over the no draw ring option; three to four L-shaped brackets each (stops) are bolted into both the draw and pressure rings around their perimeters and contact milled-out areas in the respective die and punch forming bases or contours to provide the springs with preload distances and forces; typical metal for the draw ring is steel, preferably AISI 1018, typical surface finishes of 125 rms are standard for the draw ring; 63 rms are desired for the horizontal top surface and inner diameter; a 32 rms finish is desired on the horizontal relief surface; pins and bushings are optionally added to the draw and pressure rings and die and punch bases to minimize rotation of the rings; inner diameter of the pressure ring may be located relatively inwardly at a position generally corresponding to the outer part of the second annular transition of the container or relatively outwardly at a position generally corresponding to the inner part of the arcuate outer flange or at a suitable location therebetween; the draw and pressure ring inner diameters should be slightly larger than the matching bases and/or contours such as to provide for free movement but not to allow significant misalignments due to loose tolerances—0.005" to 0.010" clearance per side (0.010" to 0.020" across the diameter) is typical; four to eight compression springs each per draw ring and pressure ring typically are used to provide a preload and full load force under pre and full deflections; machined clearance holes for the springs should be chamfered to ensure no binding of the springs during the deflection; the spring diameters, free lengths, manufacturer and spring style can be chosen as desired to obtain the desired draw ring and pressure ring preloads, full load and resulting movements and clamping action; to obtain the desired clamping action the preload of the pressure ring springs (total force) should be slightly greater than the fully compressed load of the draw ring springs (total force); the preload of the draw ring springs should be chosen to provide adequate pleating control while not clamping excessively hard on the blank while in the draw ring relief, for example, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.375" preload on each spring provides a total preload force of (6)×14.99 lb/in×0.375"=33.7 lbs; an additional deflection of the springs of 0.346" or (0.721" total spring deflection) results in a total full load force of (6)×14.99 lb/in×0.721"=64.8 lbs; (6) pressure ring compression springs LC-080J-10 SS (0.75" outside diameter, 0.080" wire diameter, 3.00" free length, spring rate of 20.23 lb/in×0.833 (for stainless steel)=16.85 lb/in, and a solid height of 1.095"; a 0.835" preload on each spring provides a total preload force of (6)×16.85 lb/in×0.835"=84.4 lbs (greater than draw ring full deflection spring load total force); an additional deflection of the springs of 0.46" (1.295" total spring deflection) results in a total full load force of (6)×16.85 lb/in×1.295"=130.9 lbs; or for example, (4) draw ring compression springs LC-067H-7 SS (0.60" outside diameter, 0.067" wire diameter, 1.75" free length, spring rate 24 lb/in×0.833 (for stainless steel)=19.99 lb/in, and a solid height of 0.705"); a 0.500" preload on each spring provides a total preload force of (4)×19.99 lb/in×0.500"=40.0 lbs; an additional deflection of the springs of 0.40" or (0.90" total spring deflection) results in a total full load force of (4)×19.99 lb/in×0.90"=72.0 lbs; (8) pressure ring compression springs LC-049E-18 SS (0.36" outside diameter, 0.049"

wire diameter, 2.75" free length, spring rate of 14 lb/in×0.833 (for stainless steel)=11.66 lb/in, and a solid height of 1.139"; a 1.00" preload on each spring provides a total preload force of (8)×11.66 lb/in×1.00"=93.3 lbs (greater than draw ring fully deflection spring load total force); an additional deflection of the springs of 0.50" (1.500" total spring deflection) results in a total full load force of (8)×11.66 lb/in×1.500"=140 lbs.

The springs referred to above are available from Lee Spring Co. Many other suitable components may, of course, be employed when making the inventive containers from paperboard.

Pressed paper plates of the present invention represent particularly efficient use of board. This aspect of the invention is conveniently seen by measuring the weight to strength (W/S) ratios of the plate which we define as the basis weight of the product in lbs per 3000 $ft^2$ divided by the SSI Rigidity expressed in grams required for a 0.5 inch deflection:

$$W/S \text{ ratio} = \frac{\text{Basis Weight (lbs/3000 sq. ft)}}{SSI \text{ Rigidity (grams)}}$$

A lower W/S ratio thus represents a more efficient utilization of the board. Ten inch pressed paper plates of the present invention will often have W/S ratios of less than 0.42, such as less than 0.4; preferably less than 0.375 and in many preferred cases less than 0.35. A suitable range is from about 0.42 to about 0.2.

With known pressed paper plates, wet rigidity can be a major weakness. The 10-inch plates of the present invention can have a wet Rigidity of 300 with values of 400, even 500 or 600 with up to over 900 being obtainable with 3-ply plates. These values represent exceptional performance particularly with respect to "strength throughout the meal" which is a key attribute desired by many consumers but which is lacking in most of the commercially available paper-based plates. Where values of Rigidity are given herein only for 10-inch plates, the comparable rigidities for 9-inch plates from comparable board can be estimated as being approximately 30% greater.

For applications involving very greasy foods, it may be desirable to use a construction in which the top layer of the plate is uncoated but either an intermediate layer or the base layer is provided with grease resistance. In this case, grease can be absorbed by the upper layer but considerable grease resistance provided by the lower layers to protect the table cloth or lap upon which the plate may be placed.

Examples are presented below to illustrate features of plates produced without interleaved pleats. In the following Examples plate Rigidity (also termed, "SSI Rigidity") is measured with the Single Service Institute Plate Rigidity Tester of the type originally available through Single Service Institute, 1025 Connecticut Ave., N.W., Washington, D.C. The SSI Rigidity test apparatus has been manufactured and sold through Sherwood Tool, Inc. Kensington, Conn. This test is designed to measure the Rigidity (i.e., resistance to bending) of paper and plastic plates, bowls, dishes, and trays by measuring the force required to deflect the rim of these products a distance of 0.5 inch while the product is supported at its geometric center. Specifically, the plate specimen is restrained by an adjustable bar on one side and is center supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. Plate Rigidity is expressed in SSI values as grams per 0.5 inch deflection. Ten-inch pressed paper plates made in accordance with the invention typically have rigidities of at least 300 grams per 0.5 inch deflection with respect to a lead applied to the plate, more preferably a Rigidity of at least 450 grams per 0.5 inch deflection, and yet more preferably a Rigidity of at least about 500 grams per 0.5 inch. These values are quite difficult to obtain with conventional pressed paper plates as these plates become more and more difficult to press properly as basis weight is increased past 250 lbs/3000 sq. ft. with values over 450 and 500 representing what we believe to be new benchmarks for pressed paper plates. A higher SSI value is desirable since this indicates a more rigid product. All measurements were done at standard TAPPI conditions for paperboard testing, 72° F. and 50% relative humidity. Geometric mean averages for the machine direction (MD) and cross machine direction (CD) are reported herein.

The particular apparatus employed for SSI Rigidity measurements was a Model No. ML-4431-2 SSI Rigidity tester as modified by Georgia-Pacific Corporation, National Quality Assurance Lab, Lehigh Valley Plant, Easton, Pa. 18040 using a Chatillon gauge available from Chatillon, Force Measurements Division, P.O. Box 35668, Greensboro, N.C. 27425-5668.

Performance of the containers of the invention was still further evaluated by a rim stiffness test which measures the local bending resistance of the rim with the adjacent bottom portion of the plate restrained from movement by clamp pads. While the SSI and Instron® Rigidity tests described above measure overall Rigidity of the container, some studies have shown that such overall Rigidity measurements do not always correlate well with consumer perception of plate sturdiness. This is especially true if the consumers test a plate for sturdiness without a food load. SSI Rigidity still is a valid and meaningful test to determine plate sturdiness with food loads during actual usage. A rim stiffness test was developed which included clamping a container about its bottom portion and measuring the force required for a given deflection of the rim at a location on the rim outwardly disposed with respect to the clamped bottom portion of the plate. This test measures local rim bending and has been observed to correlate well with perceptions of plate sturdiness as noted above.

In the Examples below, Examples A, B, and C are comparative examples directed to single layered plates which are not representative of the plates produced by the method of the invention and which are presented for comparison purposes. Examples 1, 2, 3, and 4 are directed to multilayered plates with non-interleaved pleats and correspond to plates produced by the method of the invention.

In Examples A-C and 1-4, all plates had a shape corresponding to the shape used for Dixie's current 10¼ inch diameter plate as described in U.S. Pat. No. 5,326,020.

EXAMPLE A

A sample plate was fabricated from a single layer of nominal 230 lb/ream clay coated paperboard platestock. The blank was 11 3/32 inch diameter and was pressed into a formed shape in commercial plate forming tooling cleared for board of the weight and tested for various performance properties. The results of the test are set forth below in Table 1.

EXAMPLE B

A sample plate was fabricated from a single layer of nominal 260 lb/ream clay coated paperboard platestock. The blank was 11 3/32 inch diameter and was pressed into a formed shape in commercial plate forming tooling cleared for board of the weight and tested for various performance properties. The results of the test are set forth below in Table 1.

EXAMPLE C

A sample plate was fabricated from a single layer of nominal 320 lb/ream SBR coated paperboard platestock. The blank was 11 3/32 inch diameter and was pressed into a formed shape in commercial plate forming tooling cleared for board of the weight and tested for various performance properties. The results of the test are set forth below in Table 1.

EXAMPLE 1

A sample plate was fabricated by scoring a top paperboard of nominal 120 lb/ream clay coated paperboard platestock together with a bottom nominal 100 lb/ream uncoated paperboard. Subsequently, top and bottom blanks were cut 11 3/32 inches in diameter. A polyvinyl acetate adhesive was applied to the top surface of the bottom blank, the adhesive dried, the blanks brought into juxtaposition and, the already scored top and bottom blanks were pressed together in commercial plate forming tooling cleared for 260 pound board. The resulting plate was tested for performance properties which are set forth below in Table 1.

EXAMPLE 2

A sample plate was fabricated by separately and individually scoring and cutting forming a top paperboard blank of nominal 160 lb/ream SBR coated paperboard platestock and a bottom blank of nominal 100 lb/ream uncoated paperboard. Both top and bottom blanks were 11 3/32 inches in diameter. A polyvinyl acetate adhesive was applied to the top surface of the bottom blank dried, and the blanks pleated and formed at the same time. The resulting plate was tested for performance properties which are set forth below in Table 1.

EXAMPLE 3

A sample plate was fabricated by separately and individually scoring and cutting a top paperboard blank of nominal 220 lb/ream clay coated paperboard platestock and a bottom blank of nominal 100 lb/ream uncoated paperboard. Both top and bottom blanks were 11 3/32 inches in diameter. A polyvinyl acetate adhesive was applied to the top surface of the bottom blank, dried, and the blanks pleated and formed at the same time. The resulting plate was tested for performance properties which are set forth below in Table 1.

EXAMPLE 4

A sample plate was fabricated by separately and individually scoring and cutting a top paperboard blank of 206 lb/ream clay coated paperboard platestock, a bottom blank of nominal 100 lb/ream uncoated paperboard, and an intermediate paperboard blank of nominal 100 lb/ream uncoated paperboard. All blanks were 11 3/32 inches in diameter. A polyvinyl acetate adhesive was applied to the top surface of the bottom blank and intermediate blank, dried, and the blanks thereafter pleated and formed at the same time. The resulting plate was tested for performance properties which are set forth below in Table 1.

TABLE 1

| | Example | | | | | | |
|---|---|---|---|---|---|---|---|
| | A | B | C | 1 | 2 | 3 | 4 |
| Basis Weight (lbs/3000 sq. ft) | 231.3 | 258.9 | 318.9 | 245.9 | 275.2 | 378.5 | 488.9 |
| Caliper (mils) | 21.2 | 25.8 | 32.3 | 22.5 | 25.3 | 34.3 | 43.9 |
| Plate Rigidity (grams/0.5") | 423 | 402 | 268 | 660 | 688 | 1007 | 1487 |
| Rim Stiffness (grams/0.1") | 962 | 1098 | 914 | 1228 | 1388 | 2338 | 3575 |
| Plate Rigidity, Wet (Water) (grams/0.5") | 220 | 269 | 264 | 570 | 403 | 621 | 998 |
| Basis Weight/ Plate Ridigity | 0.55 | 0.64 | 1.19 | 0.37 | 0.40 | 0.38 | 0.33 |

The data in Table 1 is also presented graphically in FIG. 31 which is a plot of SSI Rigidity versus basis weight for the plates in Examples A-C and 1-4 above as well as various commercially available plates and the plate of Example 5 below.

EXAMPLE 5

A sample plate was fabricated by separately and individually scoring and cutting a top paperboard blank of nominal 35 lb/ream clay coated paperboard platestock and a bottom paperboard blank of nominal 200 lb/ream uncoated paperboard. All blanks were 11 3/32 inches in diameter. A polyvinyl acetate adhesive was applied to the top surface of the bottom blank, dried, and the blanks thereafter pleated and formed at the same time to a shape described in U.S. patent application Ser. No. 12/259,487,filed Oct. 28, 2008, entitled "Pressed Paperboard Servingware with Arched Bottom Panel and Sharp Brim Transition, United States Patent Application Publication No. US 2009/0114659. The resulting plate had an actual basis weight of 255 lbs/3000 $ft^2$, a Rigidity of 643 grams per 0.5 inches of deflection and a W/S ratio of 0.4. Results are also presented graphically in FIG. 5.

Figure 31:
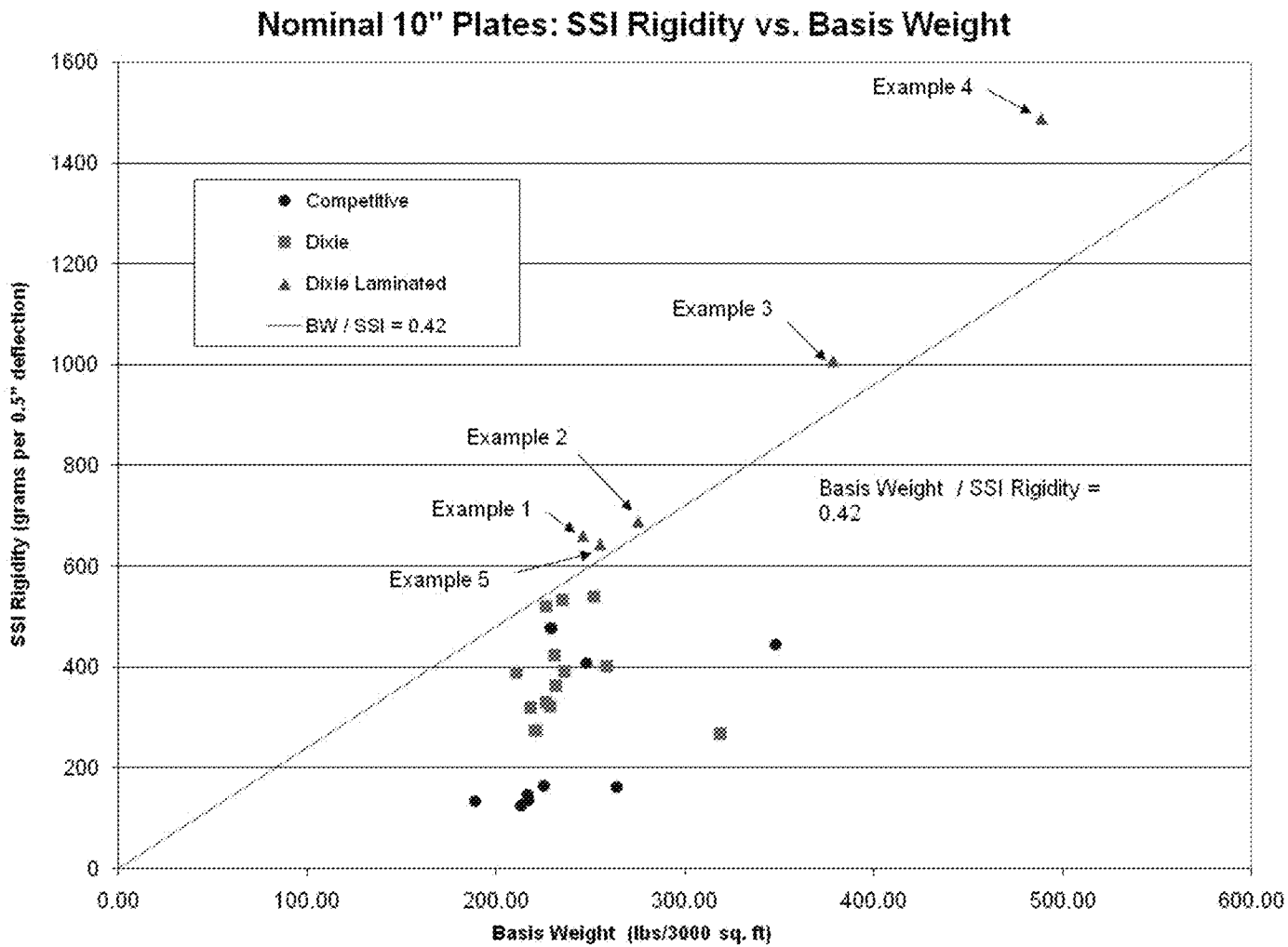
FIG. 31 is a plot of SSI Rigidity versus basis weight for various commercial disposable paper plates and multilayer plates of the present invention.

Referring to the above Table 1, Example 5 and FIG. 31, it can be seen that the plate of Example 1, which had a basis weight and caliper similar to the plate of comparative Example A, nevertheless had much higher values for plate Rigidity, rim stiffness and wet plate Rigidity than that of comparative Example A (i.e., 660, 1228 and 570, respectively as opposed to 423, 962 and 220, respectively). Similarly, the plate of Example 2, which had a basis weight and caliper similar to the plate of comparative Example B, nevertheless had much higher values for plate Rigidity, rim stiffness and wet plate Rigidity than that of comparative Example B (i.e., 688, 1388 and 403, respectively as opposed to 402, 1098 and 269, respectively). Moreover, the plate of Example 3, which had a basis weight and caliper similar to the plate of comparative Example C, nevertheless had much higher values for plate Rigidity, rim stiffness and wet plate Rigidity than that of comparative Example C (i.e., 1007, 2338 and 621, respectively as opposed to 268, 914 and 264, respectively). Accordingly, Examples 1, 2 and 3 illustrate the dramatically increased strength attainable with plates formed from two layers of bond wherein the folded regions in the pleats are in staggered array while Example 4 shows the superior strength of a multiply plate having three layers.

These results show that multilayered plates of the present invention having pleated layers such that the folded regions of the pleats of one layer do not interleave with the folded regions of the pleats of an adjacent layer, is much stronger than correspondingly sized plates having pleats which extend from the top surface of the plate to the bottom surface. It is important to note that of the Rigidity of each of plates of comparative examples A, B, and C, are excellent as compared to contemporary commercial practice. For purposes of determining the W/S ratio of a reference container, at least three samples of the reference container are tested and the results averaged to determine the W/S ratio. A single container or a multiple containers of the present invention may be used to measure the W/S ratio for purposes of comparison.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

The invention, in another aspect, relates to a method of making a pressed paperboard food service container having a substantially flat bottom surface, an upwardly curving first annular concave region surrounding said flat bottom surface, an upwardly extending sidewall section adjoining said first annular concave region, an outward flaring convex annular region, and a rim region, said pressed paperboard food service container being formed by the process of providing a punch and die; inserting at least a first blank and a second blank between said punch and die, said first blank having a selectively activatable adhesive disposed on a surface thereof adjacent to said second blank; pressing said first and second blanks to form said pressed paperboard food service container and to activate said selectively activatable adhesive, said first and second paperboard blanks being independently mobile with respect to each other prior to activation of said adhesive, the Rigidity of the food service article being at least 200 grams per 0.5 inches in deflection with respect to a load applied to the container.

The invention, in another aspect, relates to a pressed paperboard food service container having a substantially flat bottom surface, an upwardly curving first annular concave region surrounding said flat bottom surface, an upwardly extending sidewall section adjoining said first annular concave region, an outward flaring convex annular region and a rim region, said pressed paperboard food service container comprising a first layer having plurality of pleats in the outward flaring convex annular region, and a second paperboard layer adhered to the first paperboard layer and having a plurality of pleats in the outwardly flaring convex annular region formed independently of the pleats of the first paperboard layer.

The invention, in another aspect, relates to a pressed paperboard food service container having a substantially flat bottom surface, an upwardly curving first annular concave region surrounding said flat bottom surface, an upwardly extending sidewall section adjoining said first annular concave region, an outward flaring convex annular region and a rim region, said pressed paperboard container comprising a first pleated paperboard layer and a second pleated paperboard layer adhered to the first pleated paperboard layer, said pressed paperboard food service container having a Rigidity of at least 350 grams per 0.5 inch deflection.

In another aspect, the invention relates to a pressed paperboard food service container having a substantially flat bottom surface, an upwardly curving first annular concave region surrounding said flat bottom surface, an upwardly extending sidewall section adjoining said first annular concave region, an outward flaring convex annular region and a rim region, said pressed paperboard container comprising first and second layers of paper-containing material, at least one of said first and second layers having sufficient Rigidity so as to be shape-sustaining.

While the invention has been described in connection with numerous examples and embodiments, modifications within the spirit and scope of the invention will be readily apparent to those of skill in the art. In view of the foregoing discussion, relevant knowledge in the art and references including copending applications discussed above in connection with the Background and Detailed Description, the disclosures of which are all incorporated herein by reference, further description is deemed unnecessary.

What is claimed is:

1. A method for making a multilayered paper-containing product comprising the steps of:

a) providing at least a top blank of paper-containing material having a curved portion and a bottom blank of paper-containing material having a curved portion;

b) assembling said top and bottom blanks in a superposed arrangement;

c) independently forming pleats in the curved portions of the top and bottom blanks such that a plurality of the folded regions in the pleats in the top blank are arrayed in staggered arrangement with the folded regions in the pleats in the bottom blank; and, d) securing the top and bottom blanks in a fixed position relative to each other after the pleats are formed so as to form an integral shape-sustaining paper-containing product.

2. The method of claim 1, wherein at least a majority of the folded regions of the pleats in the top blank are arrayed in staggered arrangement with the folded regions in the pleats in the bottom blank.

3. The method of claim 1, wherein the top blank and the bottom blank independently range in thickness from about 2 mils to about 35 mils.

4. The method of claim 1, further including the step of scoring the top and/or bottom blank with a plurality of score lines.

5. The method of claim 4, wherein the score lines extend radially across a respective circumferential peripheral portion of each of the respective top and bottom blanks.

6. The method of claim 1, further including the step (e), applying a bonding agent to a bottom surface of the top blank and/or the top surface of the bottom blank prior to the step (b) of assembling the top and bottom blanks.

7. The method of claim 6, wherein step (e) comprises pressing the top and bottom blanks together in a die assembly under processing conditions of temperature, forming force and dwell time sufficient to bond said top and bottom blanks.

8. The method of claim 1, further including providing one or more intermediate paper blanks and positioning said intermediate paper blanks between said top blank and saidbottom blank.

9. The method of claim 8, wherein at least one of said intermediate paper blanks has a plurality of score lines for controlling the location of pleat formation.

10. A laminated paper-containing product comprising:

a) a top blank of a paper-containing material which includes a curved portion having a plurality of pleats;

b) a bottom blank of paper-containing material which includes a curved portion having a plurality of pleats, wherein the folded regions in the pleats of the bottom blank are in staggered array with the folded regions in the pleats of the top blank; and c) means for securing the top blank to the bottom blank.

11. The paper-containing product of claim 10, wherein the paper-containing material of the top blank and/or bottom blank is paperboard.

12. The paper-containing product of claim 11, wherein the paper-containing product has a plate Rigidity of at least about 300 grams per 0.5 inch of deflection.

13. The paper-containing product of claim 10, further including at least one intermediate blank of paper-containing material or polymeric material positioned between the top blank and the bottom blank.

14. The paper-containing product of claim 10, wherein at least one of the top or bottom blanks is a shape-sustaining layer.

15. A pressed paperboard food service container having a substantially flat bottom surface, an upwardly curving first annular concave region surrounding said flat bottom surface, an upwardly extending sidewall section adjoining said first annular concave region, an outward flaring convex annular region and a rim region, said pressed paperboard container comprising: first and second layers of paper-containing material, at least one of said first and second layers having sufficient Rigidity so as to be shape-sustaining, wherein said pressed paperboard container exhibits a W/S ratio of less than 0.42.

16. The pressed paperboard food service container according to claim 15, further comprising an activatable adhesive between said first and second layers.

17. The pressed paperboard food service container according to claim 16, wherein said layers are joined by actuation of said activatable adhesive during forming.

18. The pressed paperboard food service container according to claim 16, wherein activatable adhesive comprises a water soluble glue.

19. The pressed paperboard food service container according to claim 17, wherein activatable adhesive is a hot-melt adhesive having a melting point from 75° C. to 200° C.

* * * * *